US011098457B2

(12) United States Patent
Stover

(10) Patent No.: US 11,098,457 B2
(45) Date of Patent: Aug. 24, 2021

(54) LIQUID CONTAINMENT PANEL

(71) Applicant: Stoett Industries, Hicksville, OH (US)

(72) Inventor: Jack Stover, Archbold, OH (US)

(73) Assignee: STOETT INDUSTRIES, Hicksville, OH (US)

( * ) Notice: Subject to any disclaimer, the term of this patent is extended or adjusted under 35 U.S.C. 154(b) by 0 days.

(21) Appl. No.: 16/829,762

(22) Filed: Mar. 25, 2020

(65) Prior Publication Data

US 2020/0308789 A1 Oct. 1, 2020

Related U.S. Application Data

(60) Provisional application No. 62/824,407, filed on Mar. 27, 2019.

(51) Int. Cl.
*E02B 3/10* (2006.01)

(52) U.S. Cl.
CPC ..... *E02B 3/106* (2013.01)

(58) Field of Classification Search
CPC ..... E02B 3/106; E02B 7/08; E02B 3/10
USPC ..... 405/107, 114
See application file for complete search history.

(56) References Cited

U.S. PATENT DOCUMENTS

| | | | | |
|---|---|---|---|---|
| 1,192,207 | A * | 7/1916 | Kahn | E04B 1/2604 403/174 |
| 4,596,491 | A * | 6/1986 | Dietzler | F16L 9/18 405/154.1 |
| 6,413,014 | B1 * | 7/2002 | Melin | E02D 29/025 405/107 |
| 9,951,488 | B2 * | 4/2018 | Arciszewski | E01F 15/08 |
| 2012/0315093 | A1 * | 12/2012 | Taylor | E02B 3/108 405/114 |
| 2015/0184350 | A1 * | 7/2015 | Taylor | E02B 3/108 405/109 |

FOREIGN PATENT DOCUMENTS

| | | | |
|---|---|---|---|
| CN | 106905607 | * | 6/2017 |
| DE | 10237862 | * | 3/2004 |
| GB | 2515291 | * | 12/2014 |
| WO | WO 2004/038133 | * | 5/2004 |

* cited by examiner

*Primary Examiner* — Sean D Andrish
(74) *Attorney, Agent, or Firm* — Michael E. Dockins; Shumaker, Loop & Kendrick, LLP

(57) ABSTRACT

Articles of manufacture, systems, and methods relating to a liquid containment panel are provided, where the liquid containment panel includes a body comprising a thermoplastic olefin. The body has a substantially horizontal portion and a substantially vertical portion and is configured to be freestanding with the substantially vertical portion in an upright position. One or more coupling features can be located along one or more edges of the body, where such coupling features can couple the liquid containment panel to another liquid containment panel to form a barrier or containment system.

20 Claims, 20 Drawing Sheets

LIQUID CONTAINMENT PANEL

CROSS-REFERENCE TO RELATED APPLICATIONS

This application claims the benefit of U.S. Provisional Application No. 62/824,407, filed on Mar. 27, 2019. The entire disclosure of the above application is incorporated herein by reference.

FIELD

The present technology relates to a panel used to divert or hold a liquid, including a liquid containment panel having a body and a frame, where the panel can alone or cooperatively form a liquid barrier or containment system useful in managing a volume of a liquid, including flood water.

INTRODUCTION

This section provides background information related to the present disclosure which is not necessarily prior art.

There are many instances where it is necessary to manage various volumes of liquids, for diversion or containment purposes, as well as for protection of various structures, materials, or property from such liquids. In certain cases, a liquid volume may require relatively rapid or emergency management, such as in the case of flooding or the accidental release of a hazardous liquid. Other times it can be important to establish temporary reservoirs for certain liquid volumes or to temporarily divert a liquid during certain activities, such as construction projects, infrastructure repairs, agricultural practices, etc.

One common problem relates to flooding, whether resulting from melted snow, heavy rain, storms and storm surges, or tidal effects, which can cause significant property damage and sometimes personal injury. Various types of flood barriers are employed to mitigate the effects of flood waters. For example, a significant amount of flood damage is caused by flooding of less than three feet deep, where effective flood control can hence be provided using a barrier that is only few feet in height. One longstanding example of such a barrier includes structures formed using sandbags. However, sandbags are slow to construct and deployment and subsequent deconstruction of sandbag barriers require considerable amounts of labor and materials. Other types of flood barriers include various walls and sectional barriers, inflatable or fillable structures, and various flexible and/or folding components that attempt to economize space during storage and unfold upon deployment.

Accordingly, there is a need for a liquid containment means that can be rapidly deployed (e.g., during imminent flood conditions), cooperatively assembled without skilled labor or specialized tools, that is reusable, durable, effective, rapidly assembled/disassembled, efficient to store and transport, and inexpensive to manufacture.

SUMMARY

The present technology includes articles of manufacture, systems, and processes that relate to one or more liquid containment panels, structures formed using such panels, and uses of such panels in diverting or containing liquids.

Liquid containment panels are provided that include a body having a substantially horizontal portion and a substantially vertical portion. The body can be configured to be freestanding with the substantially vertical portion in an upright position. The body can include a thermoplastic olefin, where, for example, the thermoplastic olefin can include particles of elastomer in a matrix of thermoplastic. The substantially vertical portion can have a projection along a top edge thereof, where the projection can extend over the substantially horizontal portion. The body can also be configured so that the substantially horizontal portion and the substantially vertical portion have a substantially L-shaped cross-section. A plurality of corrugations can be included in the body of the liquid containment panel and/or a frame can be provided that is configured to engage at least one of the substantially horizontal portion and the substantially vertical portion of the body. It is also possible to have at least a portion of the plurality of corrugations configured to receive a portion of the frame when the frame engages the at least one of the substantially horizontal portion and the substantially vertical portion of the body. The frame and/or the substantially horizontal portion of the body can include one of an aperture and a mounting point for coupling the frame to the ground using one of a spike and an earth screw, for example. A first coupling feature can also be provided along a first side edge of the body, where the first coupling feature can be configured to couple the liquid containment panel to another liquid containment panel along the first side edge. Likewise, a second coupling feature can be provided along a second side edge of the body, where the second coupling feature can be configured to couple the liquid containment panel to another liquid containment panel along the second side edge.

Liquid containment systems are provided that include a plurality of liquid containment panels, as described herein. The plurality of containment panels can include one or more curved liquid containment panels, including curved liquid containment panels for forming an inside curve and/or an outside curve. For example, multiple liquid containment panels can include curved liquid containment panels forming an inside curve to at least partially to completely surround or circumscribe an area and contain a liquid therein. In such instances, the substantially horizontal portion of the body of the liquid containment panel can be directed toward the area being surrounded or circumscribed. Multiple liquid containment panels can also include curved liquid containment panels forming an outside curve to at least partially to completely surround or circumscribe an area and exclude a liquid from entering therein. In such instances, the substantially horizontal portion of the body of the liquid containment panel can be directed outward from the area being surrounded or circumscribed.

The present technology further contemplates variants of the liquid containment panel, heterogeneous or homogeneous groups of liquid containment panels, nesting or stackable panels, panels with and without frames, panels with one or more frames, panels with multiple bodies per frame, various liquid containment systems, and methods of containing liquids using panels as described.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 12:
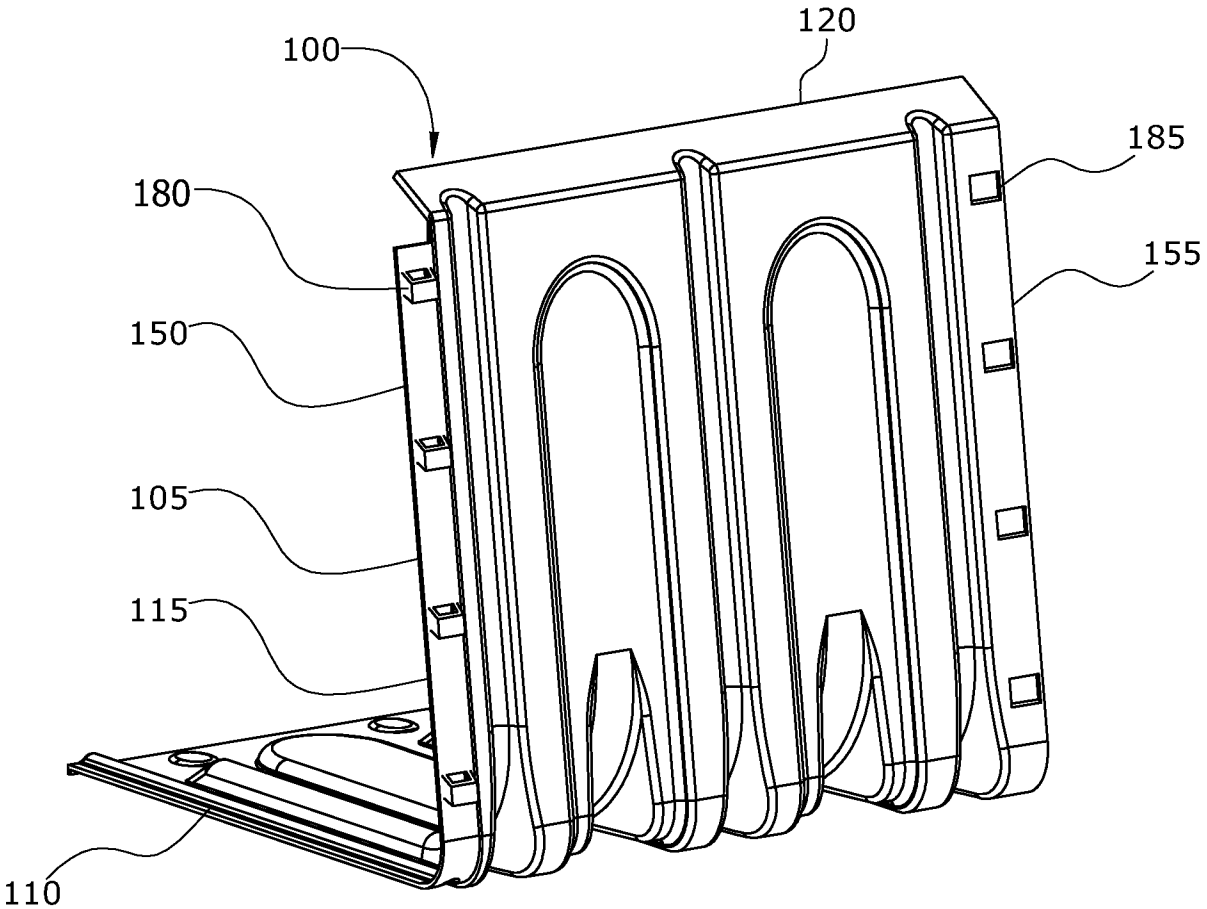
FIG. 12 shows a perspective view of yet another liquid containment panel having having loop and aperture coupling features.
Figures 13A, 13B, 13C:
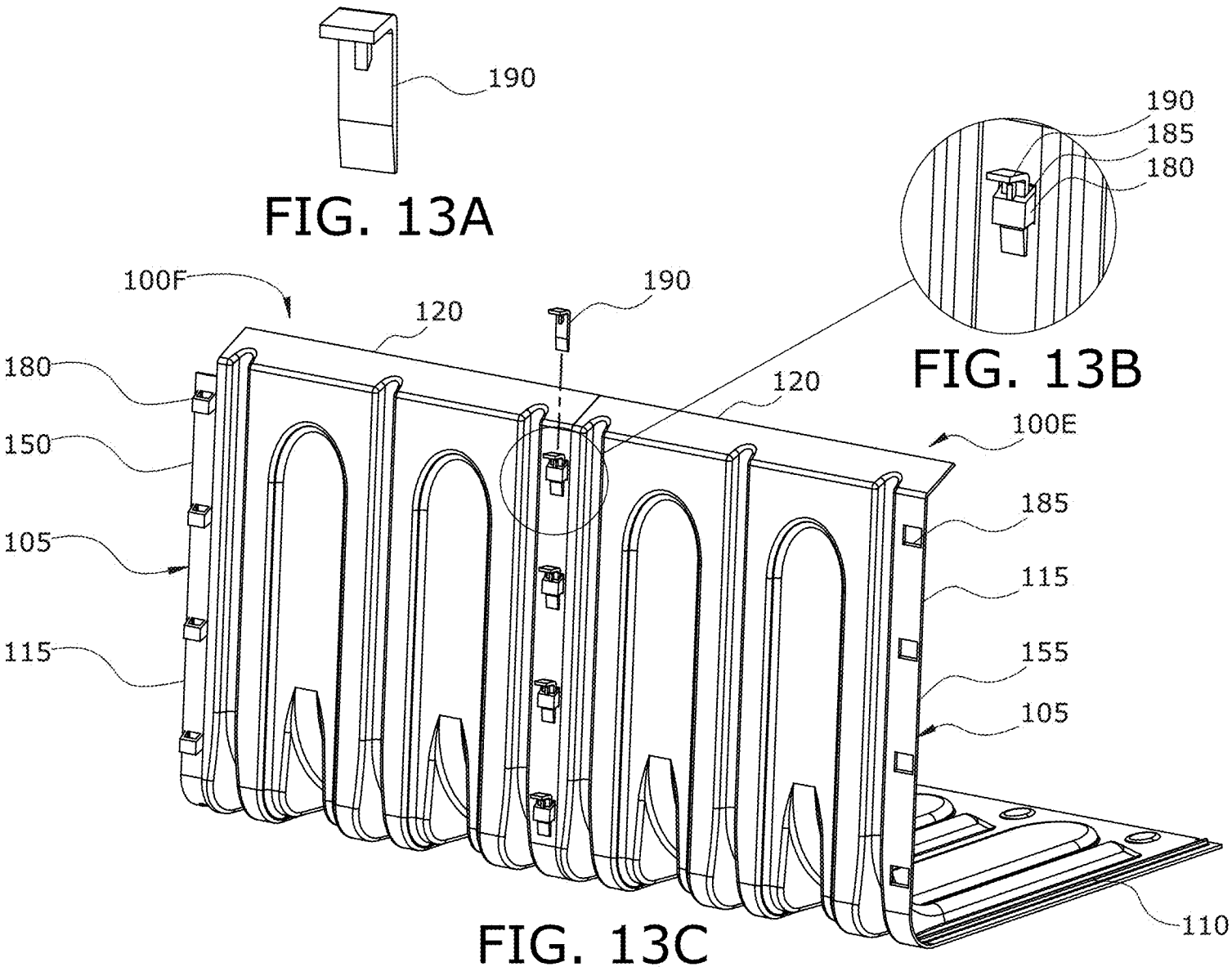

FIG. 13A shows a wedge that can be placed through a loop coupling feature of one liquid containment panel that is inserted through an aperture of another liquid containment panel, as shown in the detailed view of FIG. 13B, where FIG. 13C shows a perspective view of two liquid containment panels according to FIG. 12 being joined by insertion of the respective loops through the respective apertures and further being secured using wedges placed through the loops.

Figure 9:
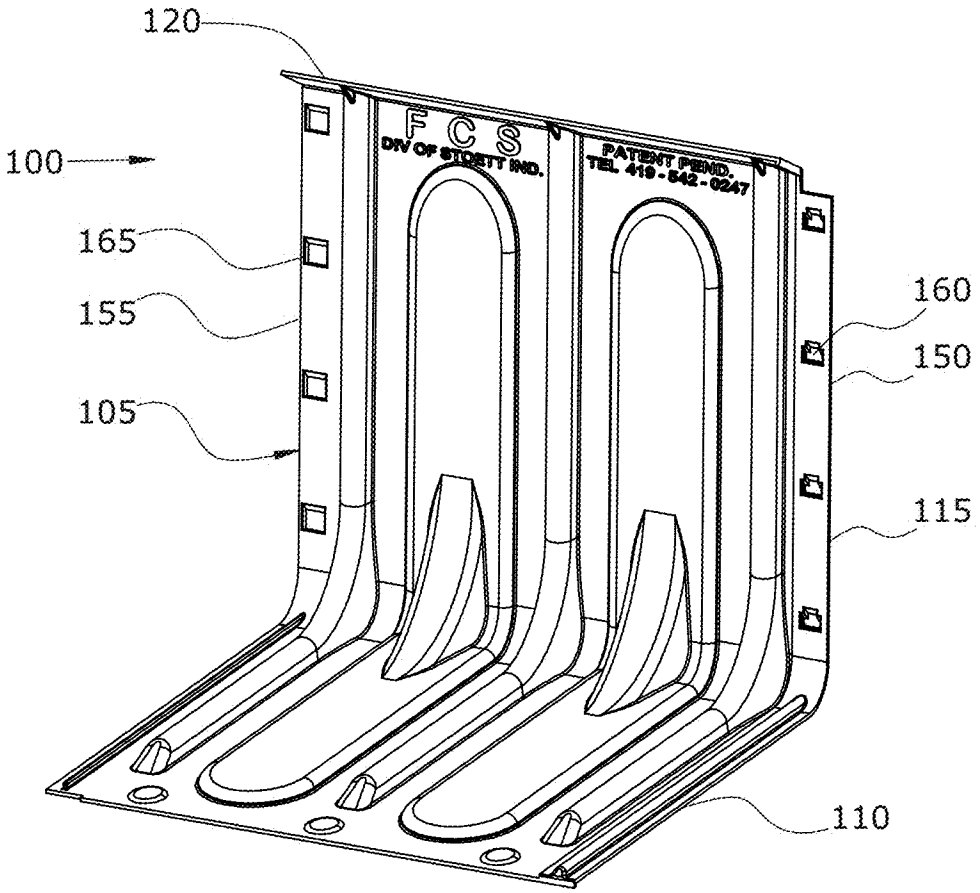
FIG. 9 shows a perspective view of another liquid containment panel having male and female coupling features along edges thereof.
Figures 14A, 14B:
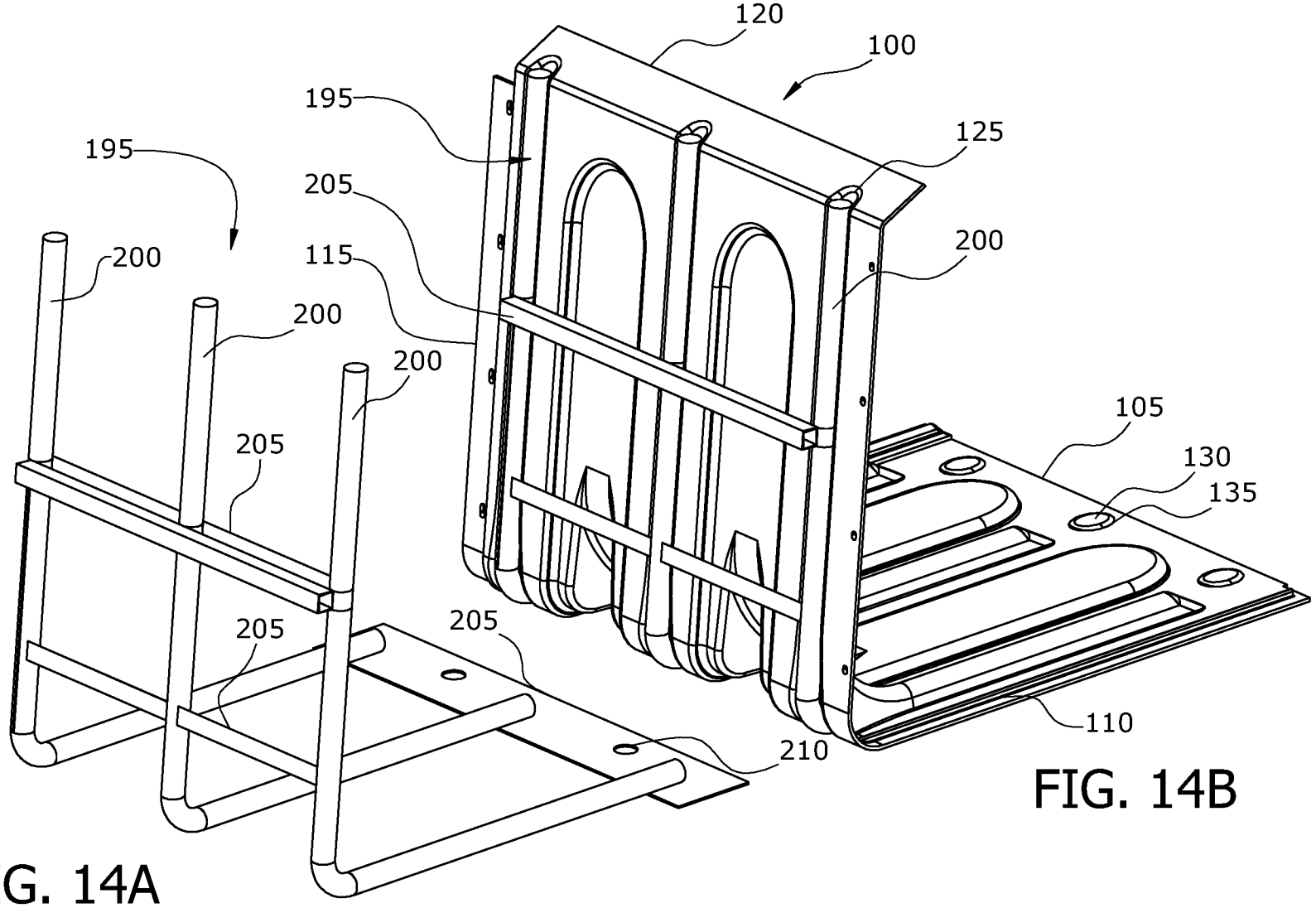

FIG. 14A shows a perspective view of a frame and FIG. 14B shows how the frame can engage the embodiment of the liquid containment panel according to FIG. 9.

Figure 15:
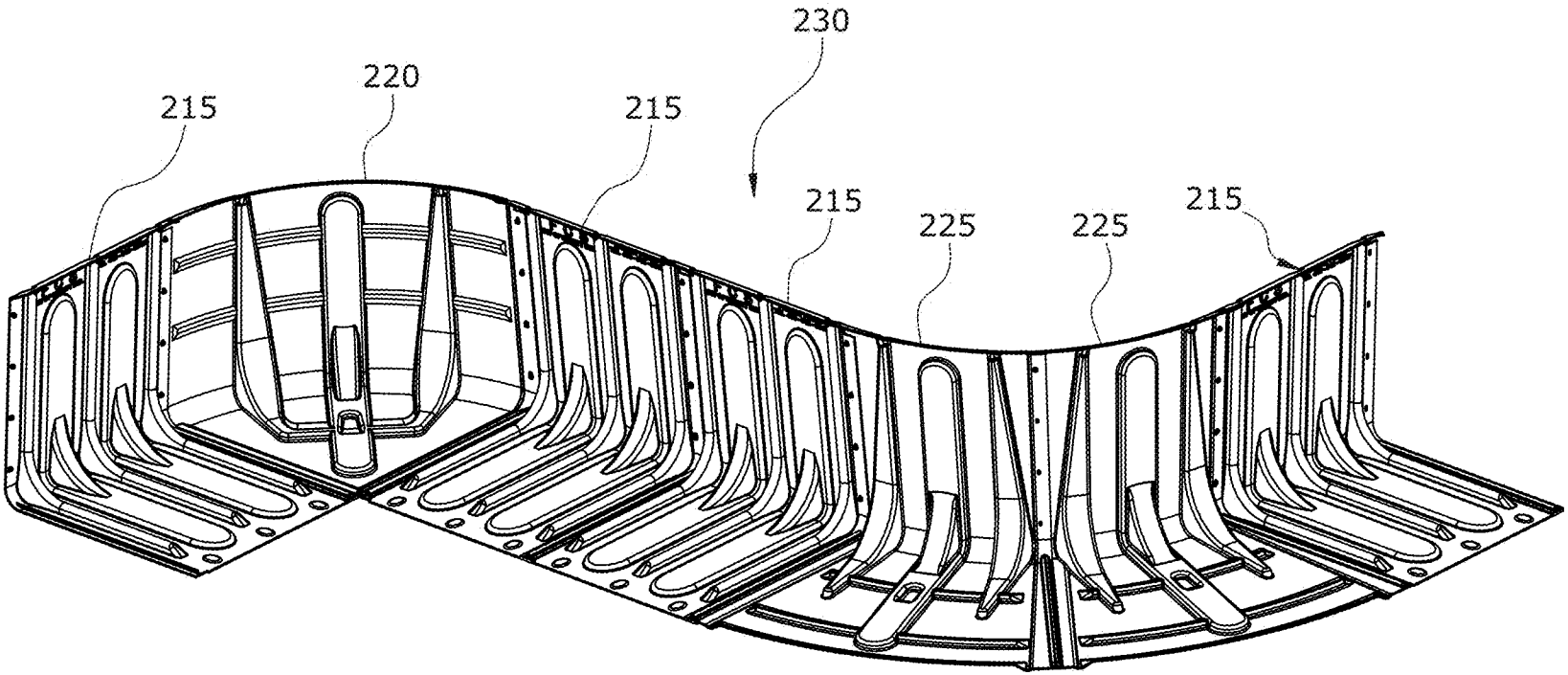

FIG. 15 shows a perspective view of multiple liquid containment panels coupled together, including straight liquid containment panels joined by an inside-curve liquid containment panel and straight liquid containment panels joined by outside-curve liquid containment panels.

Figures 16A, 16B, 16C:
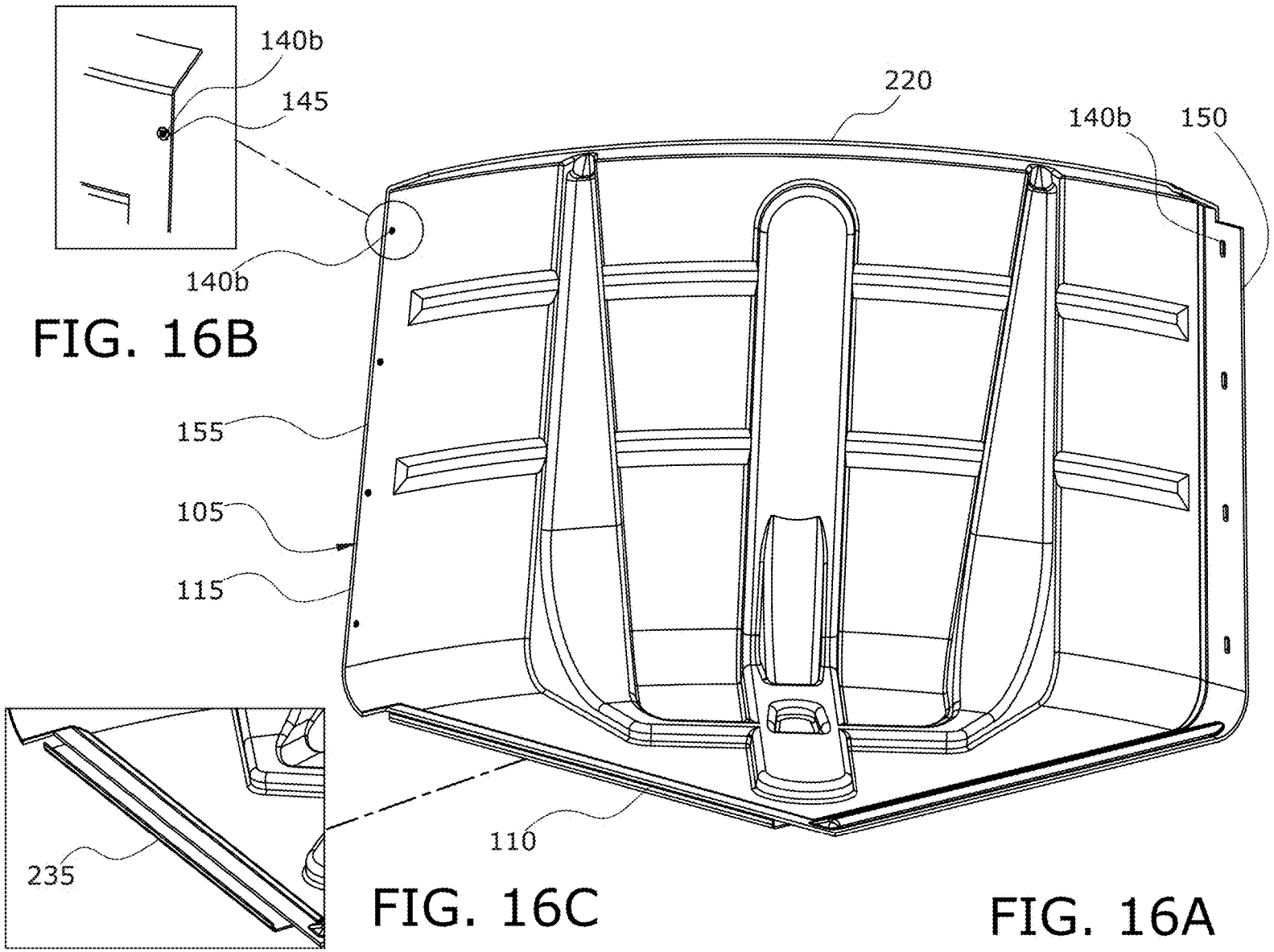

FIG. 16A shows the inside-curve liquid containment panel according to FIG. 15, where FIG. 16B shows a detailed view of a coupling feature for joining the inside-curve liquid containment panel to another liquid containment panel and FIG. 16C shows a detailed view of a bracket for coupling a horizontal portion of the body of the inside-curve liquid containment panel to another liquid containment panel.

Figures 17A, 17B:
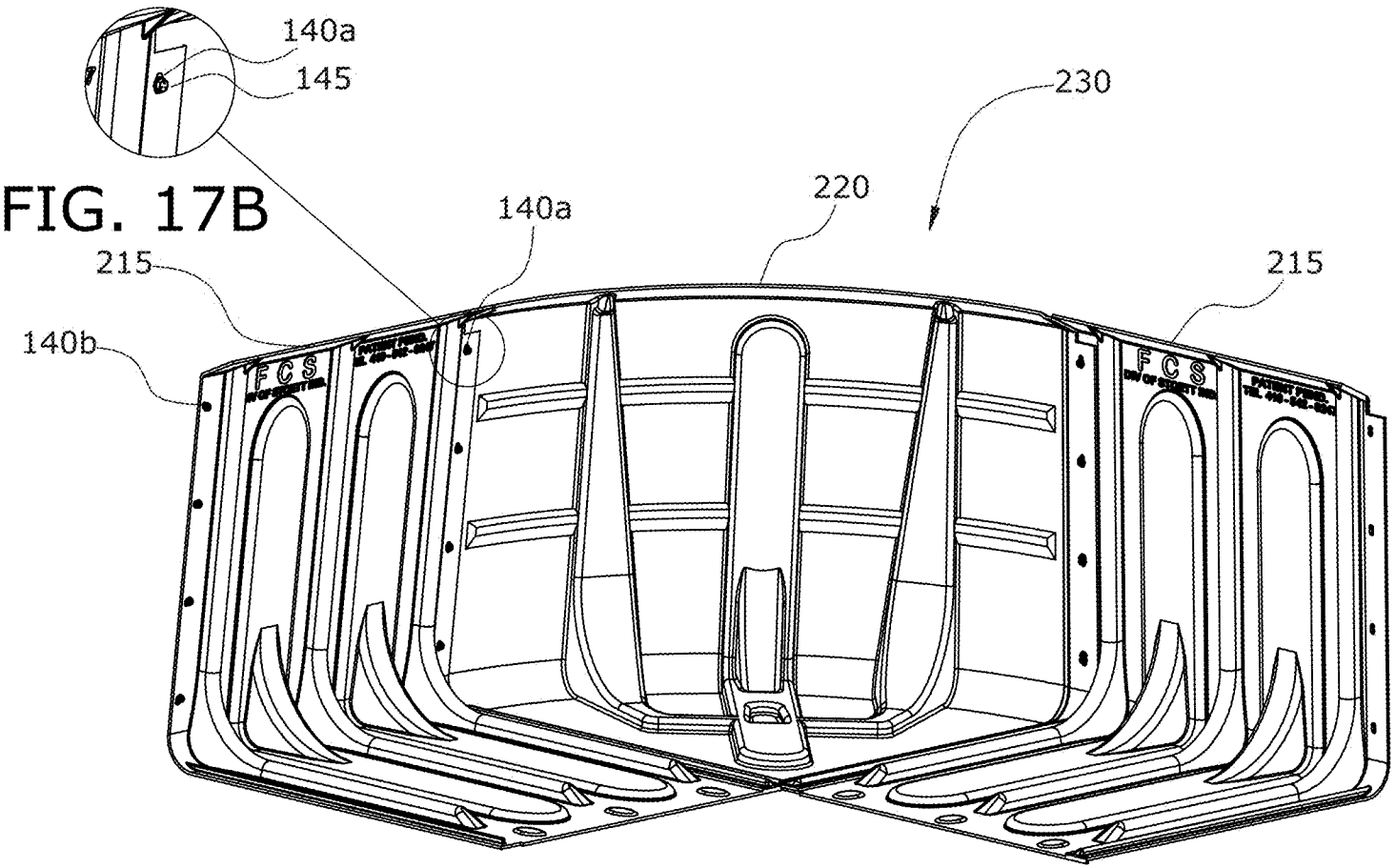

FIG. 17A shows the inside-curve liquid containment panel according to FIGS. 15 and 16A, where the coupling feature joins a vertical portion of a body of the inside-curve liquid containment panel to a vertical portion of a body of a straight liquid containment panel and the bracket couples the horizontal portion of the body of the inside-curve liquid containment panel to the horizontal portion of the body of the straight liquid containment panel, with FIG. 17B providing an inset of FIG. 17A that details a coupling feature between the respective panels.

Figure 18:
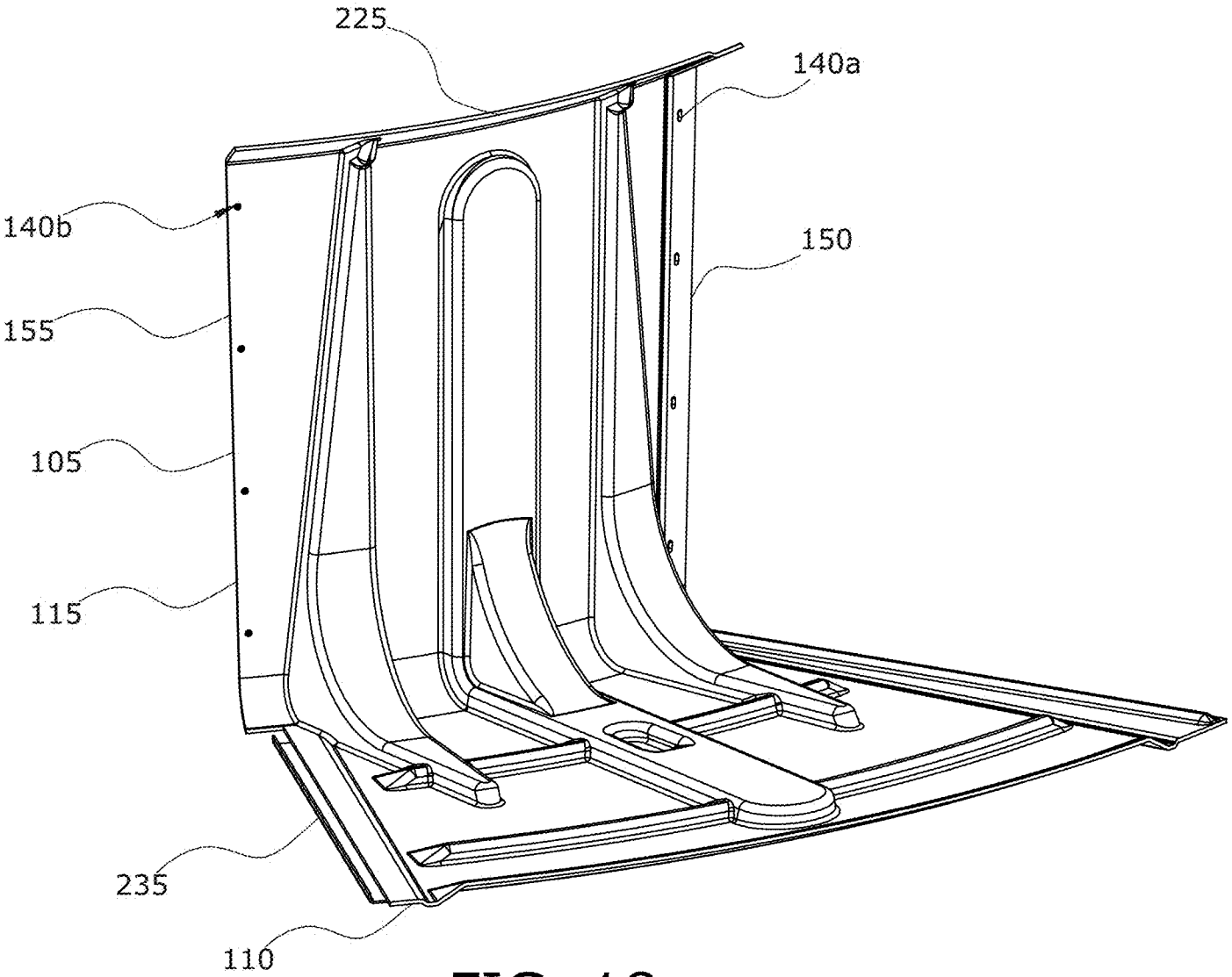

FIG. 18 shows the outside-curve liquid containment panel according to FIG. 15, including a coupling feature for joining the outside-curve liquid containment panel to another liquid containment panel and a bracket for coupling a horizontal portion of the body of the outside-curve liquid containment panel to another liquid containment panel.

Figure 19:
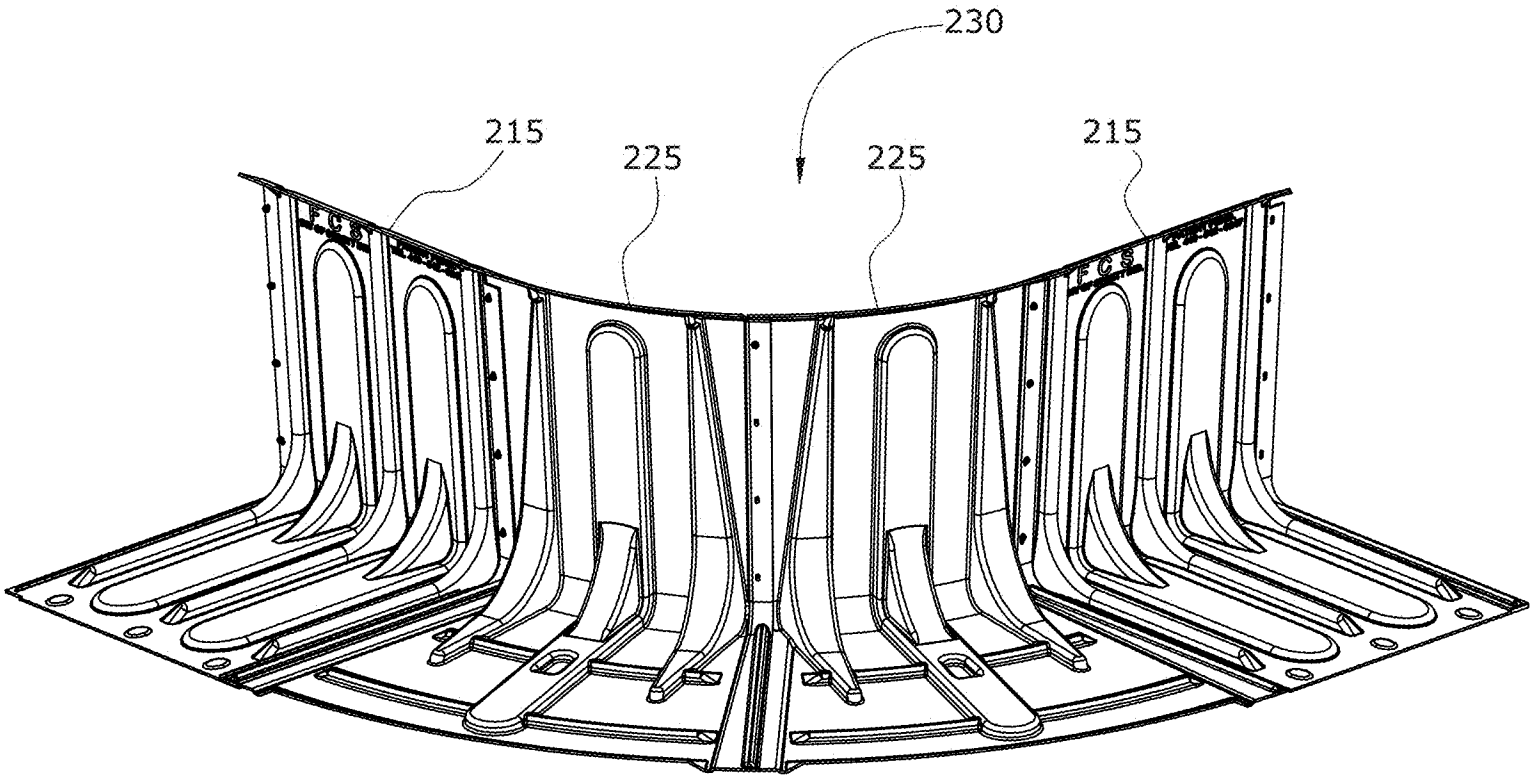

FIG. 19 shows how two outside-curve liquid containment panels can be coupled together to further curve a structure formed from multiple liquid containment panels.

Figure 20:
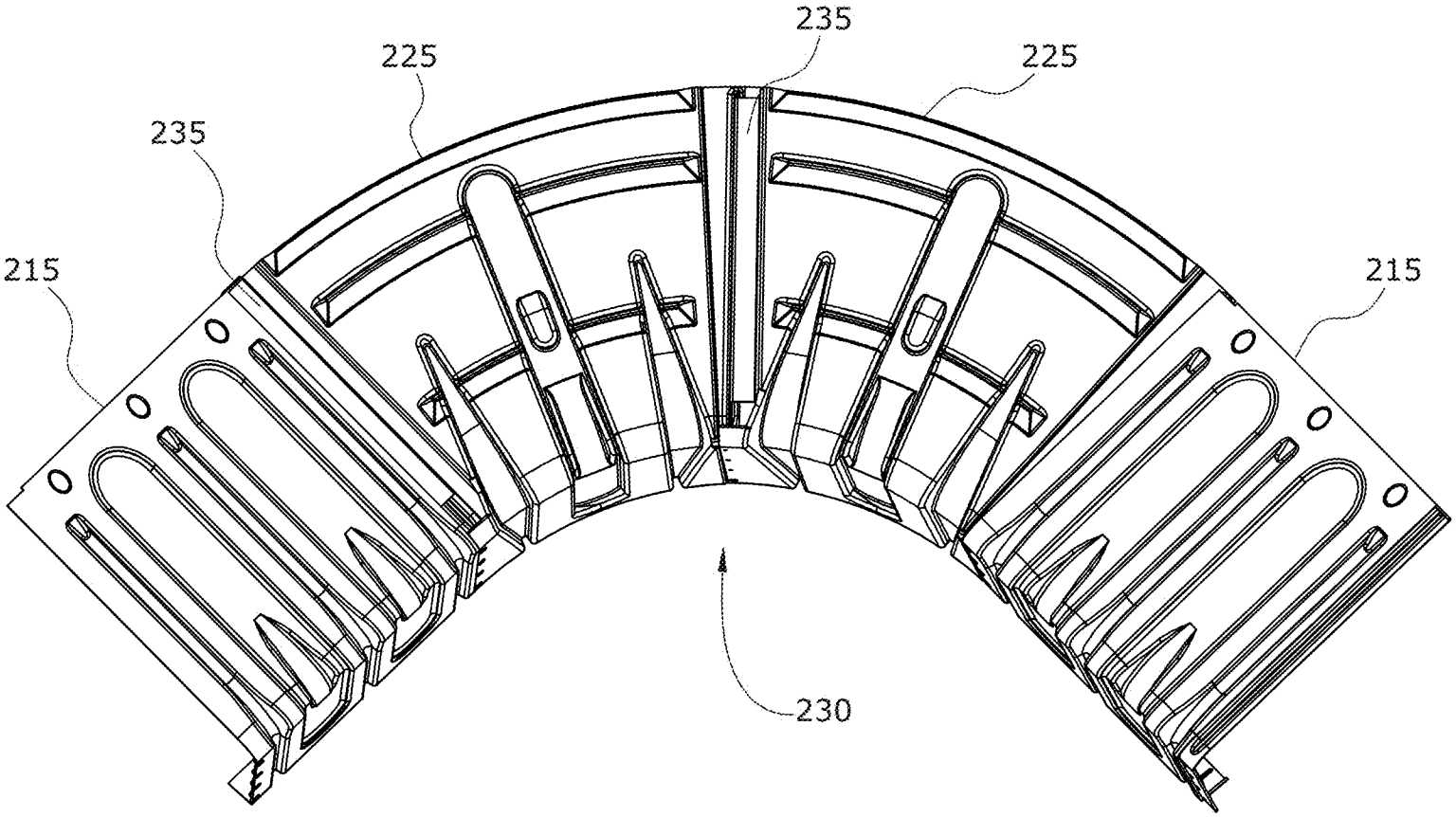

FIG. 20 shows an underside of FIG. 19, where brackets for coupling the horizontal portions of the body of the outside-curve liquid containment panels to each other and to another liquid containment panel are visible.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology provides liquid containment panels that can be rapidly deployed (e.g., during imminent flood conditions), cooperatively assembled without skilled labor or specialized tools, that are reusable, effective, rapidly assembled/disassembled, efficient to store and transport, and inexpensive to manufacture. To such ends, liquid containment panels provided herein can include a body having a substantially horizontal portion and a substantially vertical portion. The body can be configured to be freestanding with the substantially vertical portion in an upright position, where the body comprises a thermoplastic olefin. A plurality of corrugations can be formed in the body and a plurality of frame channels can be formed in the body. A frame can be disposed within the plurality of frame channels.

With respect to the body of the liquid containment panel, the substantially horizontal portion is meant to be substantially horizontal relative to a surface the liquid containment panel is set upon. For example, where the liquid containment panel is set upon substantially flat ground, the substantially horizontal portion can be adjacent or against the surface of the ground and can substantially conform to the ground surface. The substantially horizontal surface can be substantially parallel with the surface it is set upon. For example, the substantially horizontal portion can be substantially planar and set upon a substantially planar surface. It is also possible for the substantially horizontal portion to have an irregular surface, including various surface contours, to have corrugations formed therein, have texturing including recesses and/or protrusions formed therein, etc. and still provide an overall substantially horizontal conformation and appearance, including an overall substantially planar conformation and appearance.

With respect to the body of the liquid containment panel, the substantially vertical portion is meant to be substantially vertical relative to a surface the liquid containment panel is set upon. For example, where the liquid containment panel is set upon substantially flat ground, the substantially vertical portion can extend upwards away from the ground surface. The substantially horizontal surface can be substantially perpendicular with the surface the liquid containment panel is set upon. The substantially horizontal portion can be substantially planar and configured as a vertical wall. It is also possible for the substantially vertical portion to have an irregular surface, including various surface contours, to have corrugations formed therein, have texturing including recesses and/or protrusions formed therein, etc. and still provide an overall substantially vertical conformation and appearance, including an overall substantially planar conformation and appearance.

Embodiments of the liquid containment panel include where the substantially vertical portion and the substantially horizontal portion are at a substantially right angle relative to each other. For example, where the substantially horizontal portion is set upon flat ground, the substantially vertical portion can extend away therefrom at about a right angle (i.e., about 90 degrees). Embodiments are contemplated where the substantially vertical portion and the substantially horizontal portion are at an angle from about 70 degrees to about 110 degrees relative to each other, including angles from about 75-105 degrees, 80-100, degrees, and 85-95 degrees relative to each other.

It is also understood that in certain embodiments the portions of the body of the liquid containment panel designated as the substantially horizontal portion and the substantially vertical portion can be interchangeable and that the identity thereof determined solely by which portion of the body is set upon a surface and which portion extends away or upwards from the surface. For example, in some embodiments the substantially horizontal portion and the substantially vertical portion can be identical or substantially identical, where the portion set upon the ground is then designated the substantially horizontal portion and the upright portion is then designated the substantially vertical portion.

By freestanding, it is meant that the liquid containment panel can maintain the substantially vertical portion in an upright position on a substantially level surface with respect to gravity, without falling over or folding over or having to be propped up or buttressed by other items, including sandbags, earthworks, weighted objects, etc. The body of the liquid containment panel can be freestanding on its own without the addition or coupling of a frame thereto. Thickness of portions of the body, variations and local changes in body thickness, stiffening formations such as corrugations in the body, and/or reinforcing structures present in the body be used to make the body freestanding as the overall size or dimensions of the liquid containment panel are changed or adapted for particular applications.

In certain embodiments, the body of the liquid containment panel, including the substantially horizontal portion and the substantially vertical portion, can have constant or varying thicknesses. Thickness of the body can be from about 0.125 inches to about 0.375 inches. It is also contemplated that the body can have thicknesses from about 0.188-0.313 inches and about 0.25 inches. Various portions of the body can be thicker or thinner. Thinner portions can increase flexibility and thicker portions can increase rigidity. Thicker portions of the body can also serve to reinforce certain areas of the liquid containment panel, including areas that can be used to attach, engage, couple, or contact other features or components.

The liquid containment panel can have various dimensions. Certain embodiments include where the liquid containment panel is about 4.5 feet in width and about 3.5 feet in height and length. For example, where the body including the substantially horizontal portion and the substantially vertical portion has a substantially L-shaped side cross-section, width can be measured from one side edge of the body to the other side edge of the body, height can be measured as the distance the substantially vertical portion extends upwards from the substantially horizontal portion, and length can be measured as the distance the substantially horizontal portion extends away from the substantially vertical portion. It is understood that the liquid containment panel can have other dimensions depending on the application, intended use, desired performance, etc. For example, embodiments include where the liquid containment panel is from about 2 feet to about 7 feet in width, including widths from about 3-6 feet and about 4-5 feet. Likewise, embodiments include where the liquid containment panel is from about 1 foot to about 6 feet in height, including heights from about 2-5 feet and about 3-4 feet. It is noted, however, that a significant amount of flood damage is caused by flooding of less than three feet in height, where effective flood control can hence be provided by using a liquid containment panel that is only few feet in height.

As described, the body of the liquid containment panel includes a thermoplastic olefin, which can provide particular performance benefits thereto. The thermoplastic olefin can be comprised of particles of elastomer in a matrix of thermoplastic. The particles of elastomer can include various elastomers and mixtures thereof, including polyisoprene, polybutadiene, ethylene propylene rubber, ethylene propylene diene monomer rubber, ethylene-octene, ethylbenzene, and/or styrene ethylene butadiene styrene. The matrix of thermoplastic can include various thermoplastics and mixtures thereof, including polyethylene, polypropylene, and/or block copolymer polypropylene. The thermoplastic olefin can also include one or more fillers, which can impart rigidity thereto, where such fillers can include talc, fiberglass, carbon black, carbon fiber, and/or wollastonite. It is further noted that the thermoplastic olefin can include recycled materials, including recycled elastomer and/or recycled thermoplastic. Such recycled materials may already have a filler content associated therewith or an amount of filler can be used to obtain the desired performance.

Performance characteristics of the thermoplastic olefin can be determined using methods and standard testing procedures known in the art. However, the present technology has determined particular benefits and special performance properties when the body of the liquid containment panel is formed from a thermoplastic olefin tailored to exhibit the following characteristics: a yield strain (%) between about 6 and about 10; a yield strength (MPa) between about 11 and about 16; a break (elongation %) between about 10 and about 14; a melt flow rate (g/10 min) 2.16 kg, 230° C. between about 13 and about 17; a flex strength (MPa) 2.16 kg, 230° C. between about 18 and about 20; and a Shore A hardness of at least about 93. In certain embodiments, particular benefits and special performance properties are achieved when the body of the liquid containment panel is formed from a thermoplastic olefin tailored to have a Poisson's ratio of between about 0.40 and about 0.52. These characteristics of the thermoplastic olefin impart a certain flexibility and durability to the body of the liquid containment panel.

In particular, the resultant flexibility and rubber-like nature of the thermoplastic olefin allows the substantially horizontal portion of the body of the liquid containment panel to conform to the surface upon which it is set, especially when a weight of liquid is present on top thereof. The liquid weight can press and conform the substantially horizontal portion to irregular features of the ground surface. In fact, the greater the amount of liquid in contact with the panel, the greater the sealing effect. This can provide improved contact between the substantially horizontal portion and the ground surface, minimizing the opportunity for liquid to move underneath the substantially horizontal portion of the liquid containment panel. The elastomeric character further allows any flexing experienced by the liquid containment panel to bounce back once the weight of the liquid is removed, where the panel can substantially return to its former shape. The flexible body also provides a high degree of impact resistance. The thermoplastic olefin of the body accordingly provides special performance advantages in containing liquids that further translate into advantages in durability and reuse of the liquid containment panel.

Another beneficial and advantageous property of using thermoplastic olefin in the body of the liquid containment panel is the ability to injection mold the body. In particular, injection molding can include injection of particles of elastomer suspended in a melt of thermoplastic into a mold cavity having the desired configuration of the liquid containment panel. Particles of elastomer and thermoplastic can be fed through a heated barrel and mixed using a helical screw to where a resultant melt of elastomer particles suspended in thermoplastic is injected into the mold cavity. The helical screw can be configured as a reciprocating screw and can receive pelletized material including elastomer and thermoplastic particles from a hopper. The screw can feed, mix, and homogenize thermal and viscous distributions of the thermoplastic, and can reduce heating time by mechanically shearing the materials and adding a significant amount of frictional heating to the thermoplastic. Injection molding affords a means to rapidly and efficiently form liquid containment panels having bodies of thermoplastic olefin, particularly thermoplastic olefin having the characteristics presented herein that are especially well suited to maximizing the containment or exclusion of liquid.

As mentioned, the thermoplastic olefin allows the liquid containment panel body to flex and exhibit surprising durability in containing liquids. The elastomeric character especially allows any flexing experienced by the liquid containment panel to be elastic, where the shape of the panel can substantially rebound to its original shape. This property has been shown to be remarkably advantageous in containing liquids. Various liquids experienced by the liquid containment panel can be moving, changing in level, or susceptible to temperature changes, all of which can impart changing forces upon the liquid containment panel. For example, flooding streams or rivers can provide changing currents and liquid pressures onto the panel and rising or falling liquid levels, including tidal action, can impose changing forces onto the panel. Repeated or rhythmic liquid movement, such as wave or surf action, via tidal forces and/or wind forces, can present continually oscillating forces and stresses to the panel. Such forces and movements can fatigue many materials, especially where a material is repeatedly flexed at substantially the same location, resulting in degradation in material performance, cracking, environmental stress fractures, and even material failures. The thermoplastic olefin of the present liquid containment panel body, however, demonstrates marked resilience and durability to such forces and permits the present liquid containment panels to outperform panels made solely from other plastics, including various densities of polyethylene or polypropylene and blends thereof, as well as polymers such as acrylonitrile butadiene styrene.

The thermoplastic olefin of the present liquid containment panel body is also resistant to photo-degradation and solar UV radiation unlike some other polymers, making the present liquid containment panels well suited to long periods of environmental exposure during deployment or even in outdoor storage. The thermoplastic olefin body also exhibits chemical and solvent resistance, which can be important in effectively diverting or containing a chemical or oil spill, for example. This also allows use of the same liquid containment panels in dealing with flood waters as well as chemical spills; e.g., oil, gasoline, acidic or caustic substances, etc. This is not the case with other polymers, where certain polymers may be suitable for contact with aqueous liquids but are not suited for contact with organic liquids.

Other aspects of the body of the liquid containment panel includes various measures of flexibility and hardness. For example, the body can have a composition and thickness that provides certain durometer values and certain tensile strength values. The liquid containment panel body can include various materials and composites in addition to where the body comprises elastomer particles within a thermoplastic matrix. However, the overall composition of the body of the liquid containment panel can be formulated to provide the material properties identified in Table 1.

TABLE 1

Liquid containment panel body material properties.

| Material Properties | Target | Lower Limit | Upper Limit | ASTM Test Method |
|---|---|---|---|---|
| Yield Strain (%) | 8 +/− 1 | 6 | 10 | ASTM D412 |
| Yield Strength (MPa) | 13.5 +/− 1.5 | 11 | 16 | ASTM D412 |
| Break (elongation %) | 12 +/− 1 | 10 | 14 | ASTM D412/ D638 |
| Melt Flow Rate (g/10 min) 2.16 kg, 230 C. | 15.5 +/− 1.5 | 13 | 17 | ASTM D1238 |
| Flex Strength (MPa) 2.16 kg load @ 230 C. | 20 +/− 1 | 18 | 20 | ASTM D790 |
| Shore A hardness | >94 | 93 | — | ASTM D2240 |

Multiple specimens of the material used to form the body of the liquid containment panel are further characterized by the following tabular and graphical data depictions. Materials contemplated by the present technology can include values that approximate the data presented in the following tabular and graphical depictions, including ranges of values that are between +/−10% of each of the shown values, values that are between +/−7.5% of each of the shown values, and values that are between +/−5% of each of the shown values. The material can further exhibit a Poisson's ratio between about 0.40 and 0.52, and can include a Poisson's ratio between about 0.43 and 0.49, and can include a Poisson's ratio of about 0.46.

TABLE 2

Liquid containment panel body material 50 mm strain data.

| | $Y_{(Stress)}$ MPa | Elongation at the yield point % | $T_{max}$ MPa | Elongation at maximum force % | Elongation at break % | $T_{(5)}$ MPa | Thickness mm | Width mm | A $mm^2$ |
|---|---|---|---|---|---|---|---|---|---|
| Specimen 3.1 | 12.3481 | 8.8353 | 12.3481 | 8.8353 | 11.3812 | 12.0819 | 4.0900 | 6.3700 | 26.0533 |
| Specimen 3.2 | 12.6494 | 9.1511 | 12.6494 | 9.1511 | 14.1115 | 12.3682 | 4.0900 | 6.3700 | 26.0533 |
| Specimen 3.3 | 12.5403 | 9.1068 | 12.5403 | 9.1068 | 15.2366 | 12.2134 | 4.0900 | 6.3700 | 26.0533 |

TABLE 3

Liquid containment panel body material D790 low strain data.

| | $E_H$ MPa | $E_{Sec}$ MPa | $S_{0.1}$ MPa | $S_1$ MPa | $S_2$ MPa | $r_M$ % | $r_{M\,(Corr.)}$ % |
|---|---|---|---|---|---|---|---|
| Specimen 3.1 | 743.0819 | 669.8431 | 6.8140 | 6.8759 | 12.2812 | 4.9988 | 5.0254 |
| Specimen 3.2 | 819.6040 | 724.8792 | 5.9825 | 7.4203 | 13.1758 | 4.9989 | 5.0236 |
| Specimen 3.3 | 796.0916 | 684.5469 | 4.3915 | 7.0054 | 12.4187 | 4.9990 | 5.0237 |

| | $S_M$ MPa | $r_{max}$ % | L mm | d mm | b mm |
|---|---|---|---|---|---|
| Specimen 3.1 | 19.1707 | 5.0000 | 50.0000 | 3.1400 | 12.6600 |
| Specimen 3.2 | 20.3728 | 5.0000 | 50.0000 | 3.1400 | 12.6600 |
| Specimen 3.3 | 19.3840 | 5.0000 | 50.0000 | 3.1400 | 12.6600 |

Elongation and deformation data of the liquid containment panel body material are graphically depicted in FIGS. 1-6 for three separate samples labeled 3.1, 3.2, and 3.3.

In certain embodiments of the liquid containment panel, the substantially vertical portion can have a projection along a top edge thereof. The projection can extend from the top edge of the substantially vertical portion out and over the substantially horizontal portion. In this way, the projection can direct any splash or spray of liquid against the substantially vertical portion back toward the source of the liquid, to where the liquid is contained or blocked by the liquid containment panel. For example, where the liquid containment panel has a generally L-shaped cross-section, the projection can take the form of lip of the upper edge of the substantially vertical portion that points out and over the substantially horizontal portion, where the substantially horizontal portion is placed upon a surface (e.g., the ground) in the direction of the liquid (e.g., flood waters). Movement by the liquid, whether by impact (e.g., flash flood, storm surge) or oscillations (e.g., wave or tidal action), can generate spray or splashing that can climb the substantially vertical portion, hit the projection along the top edge thereof, and can then be directed back from whence the liquid came, rather than climbing the substantially vertical portion and cresting or lapping over the top edge thereof.

Various aspects of the liquid containment panel can incorporate the following structures and functions. The body, including the substantially horizontal portion and the substantially vertical portion, can have a substantially L-shaped cross-section, as described. Other embodiments include where the body can have a cross-section generally shaped as an inverted T, where the various lengths of the substantially horizontal portion extend on either side of the substantially vertical portion. Liquid containment panels having the substantially L-shaped cross-section, however, can provide certain advantages in storage, space-savings, and the ability to be nesting and stackable to facilitate storage and transport thereof.

Embodiments of the liquid containment panel can include where the body further comprises a variety of one or more corrugations. Various sizes and configurations and corrugations can be used to impart overall rigidity to the panel and/or localized rigidity to portions of the panel. Where a plurality of corrugations are included, at least a portion of the plurality of corrugations can run between the substantially horizontal portion and the substantially vertical portion, for example, or the entirety of the plurality of corrugations can run between the substantially horizontal portion and the substantially vertical portion.

Certain aspects of the liquid containment panel include the use of a frame. The frame can be configured to engage at least one of the substantially horizontal portion and the substantially vertical portion of the body. The panel can be freestanding with or without the frame in various embodiments. The frame can provide additional support and/or rigidity to portions of the liquid containment panel and can be used to reinforce the panel when deployed in certain environments, for example, or when the panel is used to contain or provide a barrier to certain liquids. In some instances it may be necessary to contain or block liquids that are generally heavier or more dense than water, including mud or sand slurries, salt water, and other liquids or chemical solutions including denser than water particles or solutes. Engagement of the panel with the frame can provide additional reinforcement and maintain effective liquid containment in such situations. The frame can be formed of a ferrous or aluminum alloy.

As described, the body of the liquid containment panel can include a plurality of corrugations and at least a portion of these corrugations can be configured to receive a portion of the frame when the frame engages the at least one of the substantially horizontal portion and the substantially vertical portion of the body. The portion of corrugations can therefore serve as frame channels for receiving portions of the frame. Frame channels can run between the substantially horizontal portion and the substantially vertical portion. The frame can have a plurality of first members disposed within the plurality of frame channels, where the frame can include a cross member coupling the plurality of first members disposed within the plurality of frame channels. In certain embodiments, the cross member can couple the plurality of first members on one of the substantially horizontal portion and the substantially vertical portion. The frame can also include a plurality of cross members coupling the plurality of first members disposed within the plurality of frame channels. The frame and the frame channels can be configured to provide a snap fit or a press fit to couple the body and frame together. The frame and frame channel coupling can be configured to be reversible, allowing for disassembly of the liquid containment panel for storage, repair, or reconfiguration. Embodiments further include where the frame has an aperture and/or a mounting point for coupling the frame to a surface such as the ground by using a spike or earth screw, for example.

The liquid containment panel can have one or more various coupling features that allow multiple panels to be joined together to extend and form liquid containment structures, liquid exclusion structures, walls, enclosures, or liquid diversion structures of various shapes, sizes, and lengths. In certain embodiments, the liquid containment panel includes a first coupling feature along a first side edge of the body, where the first coupling feature is configured to couple the liquid containment panel to another liquid containment panel along the first side edge. Additional embodiments further include a second coupling feature along a second side edge of the body, where the second coupling feature is configured to couple the liquid containment panel to another liquid containment panel along the second side edge. It is also possible to have one of the first coupling feature and the second coupling feature of the liquid containment panel configured to be coupled to the other of the first coupling feature and the second coupling feature of another liquid containment panel using a fastener. Particular embodiments have the first coupling feature including a male coupling element and the second coupling feature including a female coupling element, where the male coupling element is configured to be received by the female coupling element, thereby allowing the first side edge of the liquid containment panel to be coupled to the second side edge of another liquid containment panel. Other embodiments include where the first coupling feature has a loop and the second coupling feature has an aperture configured to receive the loop, where a wedge or pin can be inserted into the loop when the the loop is received by the aperture, thereby allowing the first side edge of the liquid containment panel to be coupled to the second side edge of another liquid containment panel.

In this way, multiple liquid containment panels can be coupled together to form barriers, walls, or enclosures of various lengths and sizes. Portions of such coupled structures can curve and turn and follow various paths to divert or contain a liquid. Such structures of multiple liquid containment panels can also be used to form a closed barrier, including various polygonal, ovoid, or circular shapes that can encircle an area or structure to protect the area or structure from the liquid or to form an area to contain the liquid therein or where the area is then filled with the liquid. Coupling of liquid containment panels together can provide an optimized joint and seal that is leak resistant. In certain embodiments, the coupling feature can provide a substantially water tight joint and multiple coupled liquid containment panels can provide substantially water tight structures that do not require a liner or other membrane to hold, contain, block, or exclude liquid from desired areas.

Like the frame, the substantially horizontal portion of the liquid containment panel can include one or more apertures and/or mounting points for coupling the liquid containment panel to the ground using one or more spikes and/or earth screws. Such anchor points can be used to stabilize structures of multiple panels, for example, and maintain curves, turns, and certain shapes, on level or uneven ground, when the weight and/or impact of liquid is applied to the panels. Apertures can be used to insert spikes or screws therethrough without damaging the body of the liquid containment panel. Apertures and/or mounting points can be configured having thicker portions of the body surrounding such to reinforce the aperture and/or mounting point and minimize any local wear, such as tearing or cracking of the body, at such locations.

Where multiple liquid containment panels are employed, including where multiple liquid containment panels are coupled together, the panels can form a liquid containment system. Certain embodiments include where the liquid containment system has a predetermined number of liquid containment panels have predetermined shapes to form one or more predetermine structures. For example, the liquid containment system can be configured with liquid containment panels to form a defined circular enclosure having a predetermined diameter. Other instances include liquid containment systems having sets of liquid containment panels having the necessary numbers and shapes of panels to form ovals, rounded rectangles, various polygons, or walls or barriers of predefined lengths. In this way, liquid containment systems can be provided for known or established structures. Such systems can include panels having one or more curved shapes, including panels incorporating one or more fixed angles. The panels having the curved shape may include the substantially vertical portion of the body curving around a vertically arranged axis as the substantially vertical portion extends from a first side edge to an oppositely arranged second side edge thereof. Liquid containment systems are also contemplated that include variants of the liquid containment panel, heterogeneous or homogeneous groups of liquid containment panels, nesting or stackable panels, panels with and without frames, panels with one or more frames, panels with multiple bodies per frame, various combinations of liquid containment systems. Methods of deployment and use of such liquid containment systems are also contemplated by the present technology.

It is also possible to use the present liquid containment panels to hold or block certain flowable solids, such as certain powders, particulates, or granular materials, including various agricultural products such as seeds and grain, gravel, pebbles, sand, dirt, mulch, compost, and similar materials. Liquid containment systems including the liquid containment panels described herein can find use in providing temporary storage or exclusion areas during agricultural practices, construction practices, and various manufacturing practices. It is also possible to readily adapt the size, shape, or extent of protected area of the liquid containment system by adding or removing one or more panels, which provides flexibility in responding to changing conditions or needs.

EXAMPLES

With reference now to FIGS. 7-20, example embodiments of various liquid containment panels, systems of liquid containment panels, and features thereof are shown.

Figure 1:
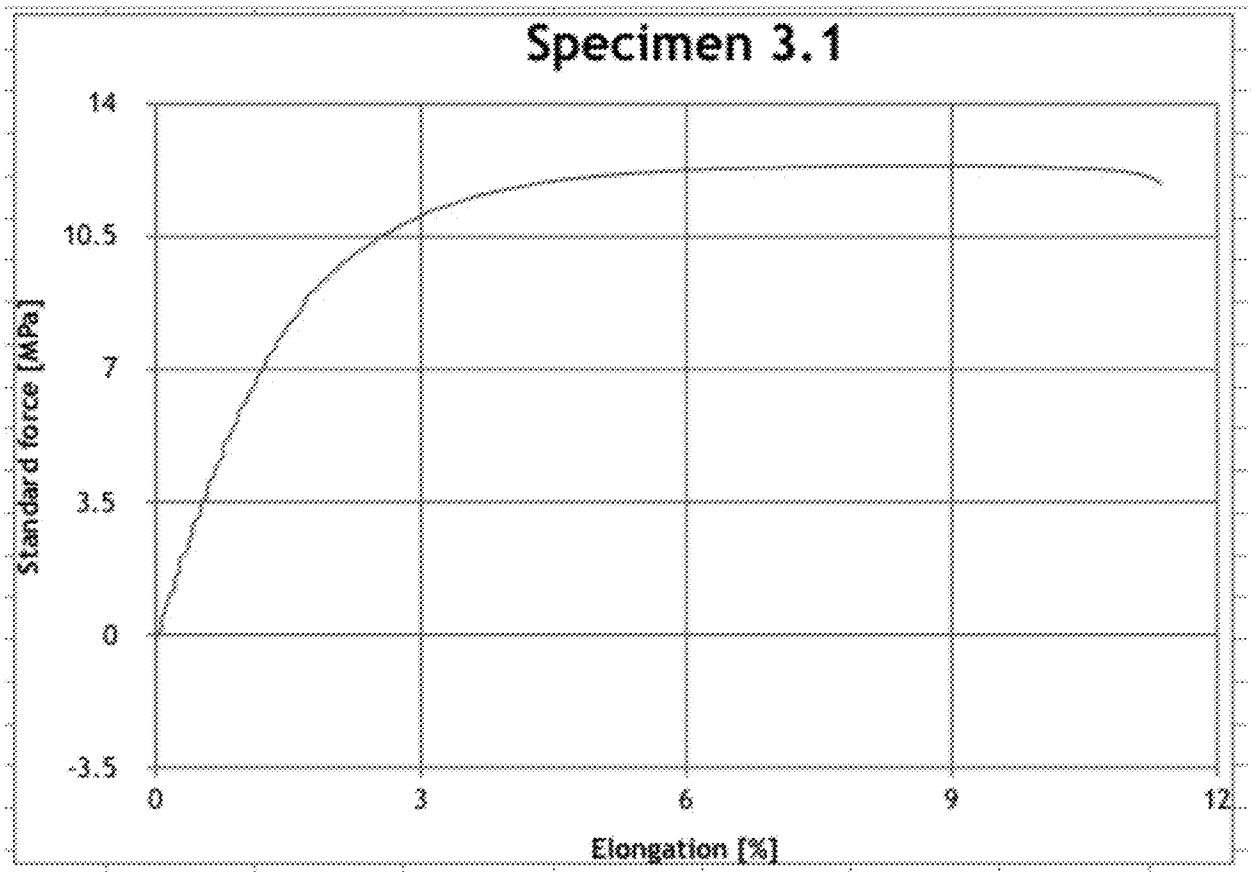
FIG. 1 shows a graphical depiction of elongation (%) versus standard force (MPa) for a first embodiment (specimen 3.1) of a thermoplastic olefin material used in a body of a liquid containment panel.
Figure 2:
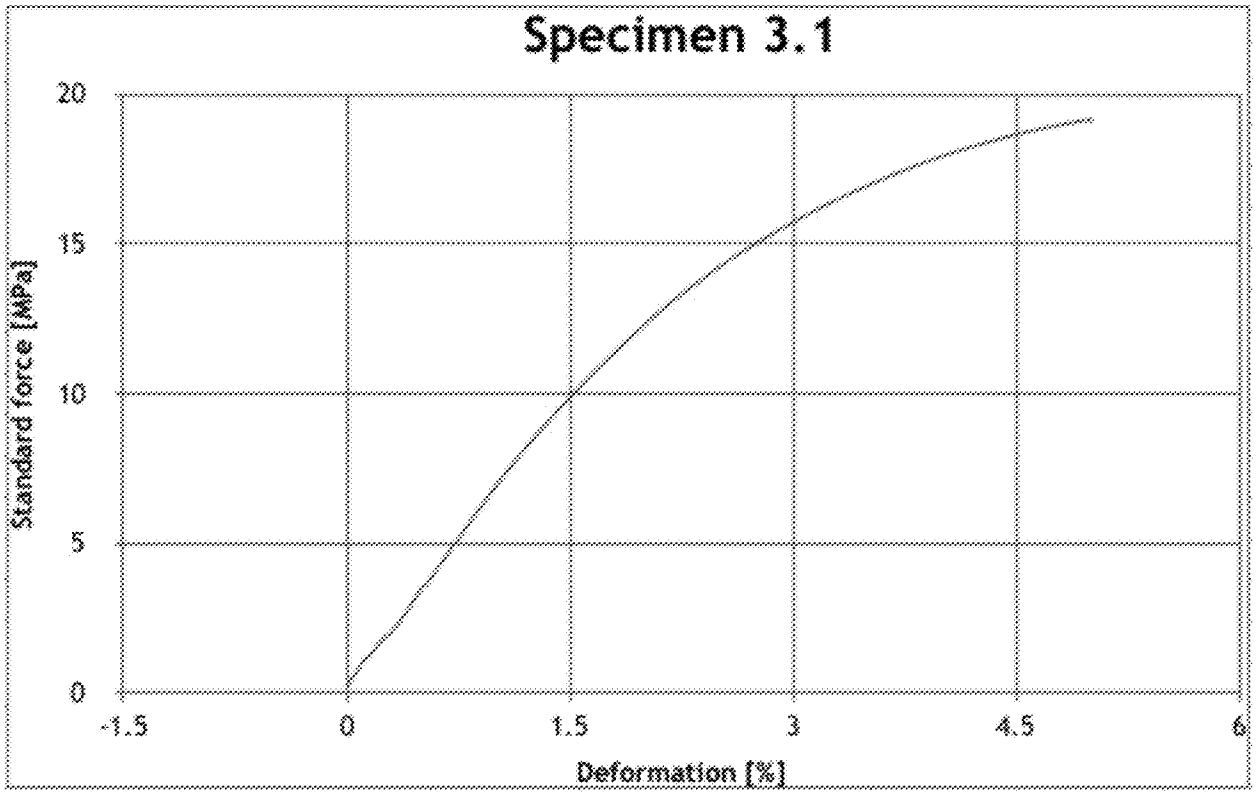
FIG. 2 shows a graphical depiction of deformation (%) versus standard force (MPa) for the first embodiment (specimen 3.1) of the thermoplastic olefin material used in the body of a liquid containment panel.
Figure 3:
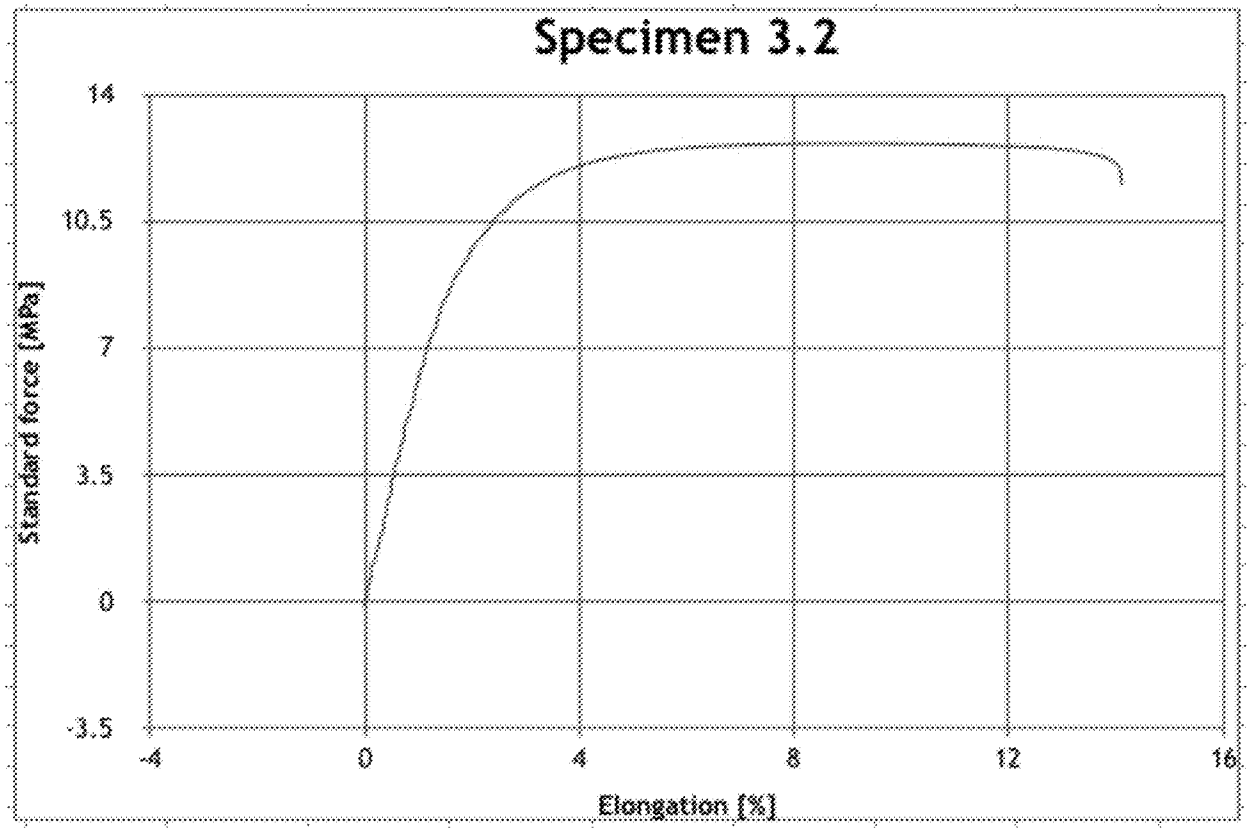
FIG. 3 shows a graphical depiction of elongation (%) versus standard force (MPa) for a second embodiment (specimen 3.2) of a thermoplastic olefin material used in a body of a liquid containment panel.
Figure 4:
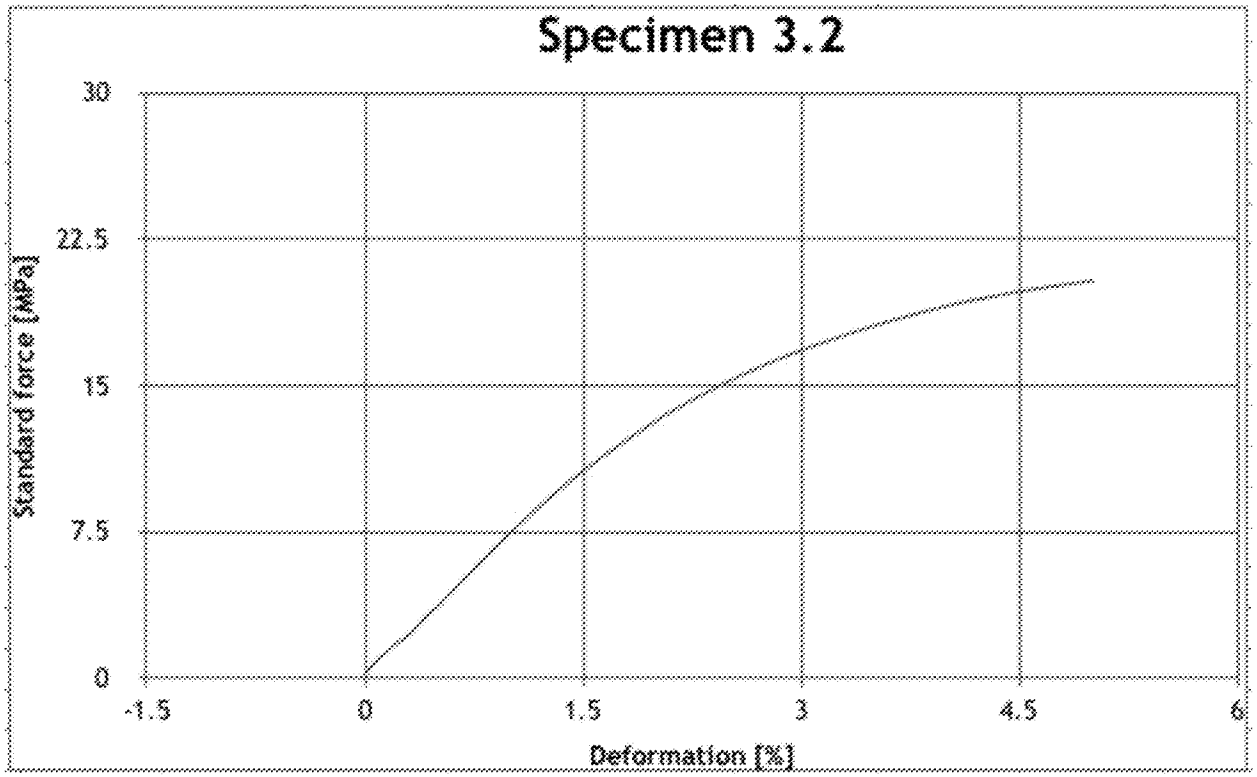
FIG. 4 shows a graphical depiction of deformation (%) versus standard force (MPa) for the second embodiment (specimen 3.2) of the thermoplastic olefin material used in the body of a liquid containment panel.
Figure 5:
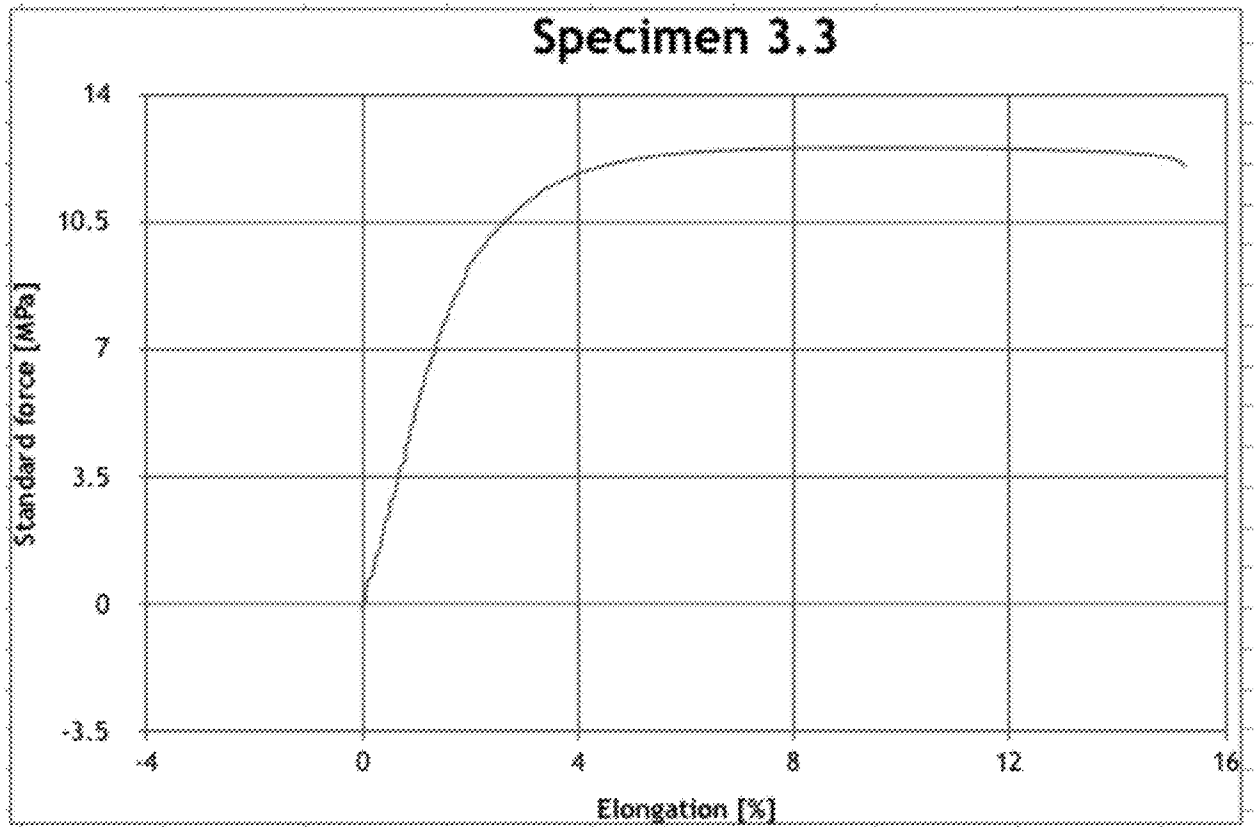
FIG. 5 shows a graphical depiction of elongation (%) versus standard force (MPa) for a third embodiment (specimen 3.3) of a thermoplastic olefin material used in a body of a liquid containment panel.
Figure 6:
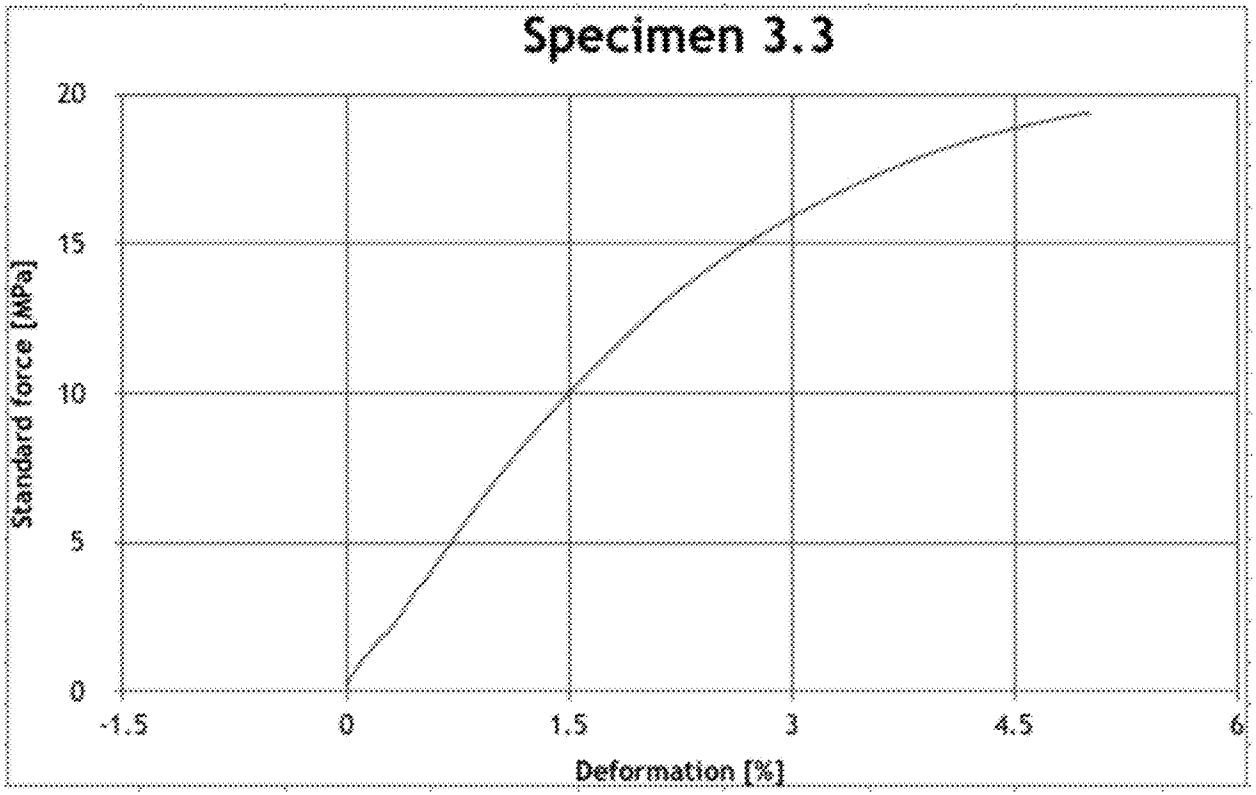
FIG. 6 shows a graphical depiction of deformation (%) versus standard force (MPa) for the third embodiment (specimen 3.3) of the thermoplastic olefin material used in the body of a liquid containment panel.
Figure 7:
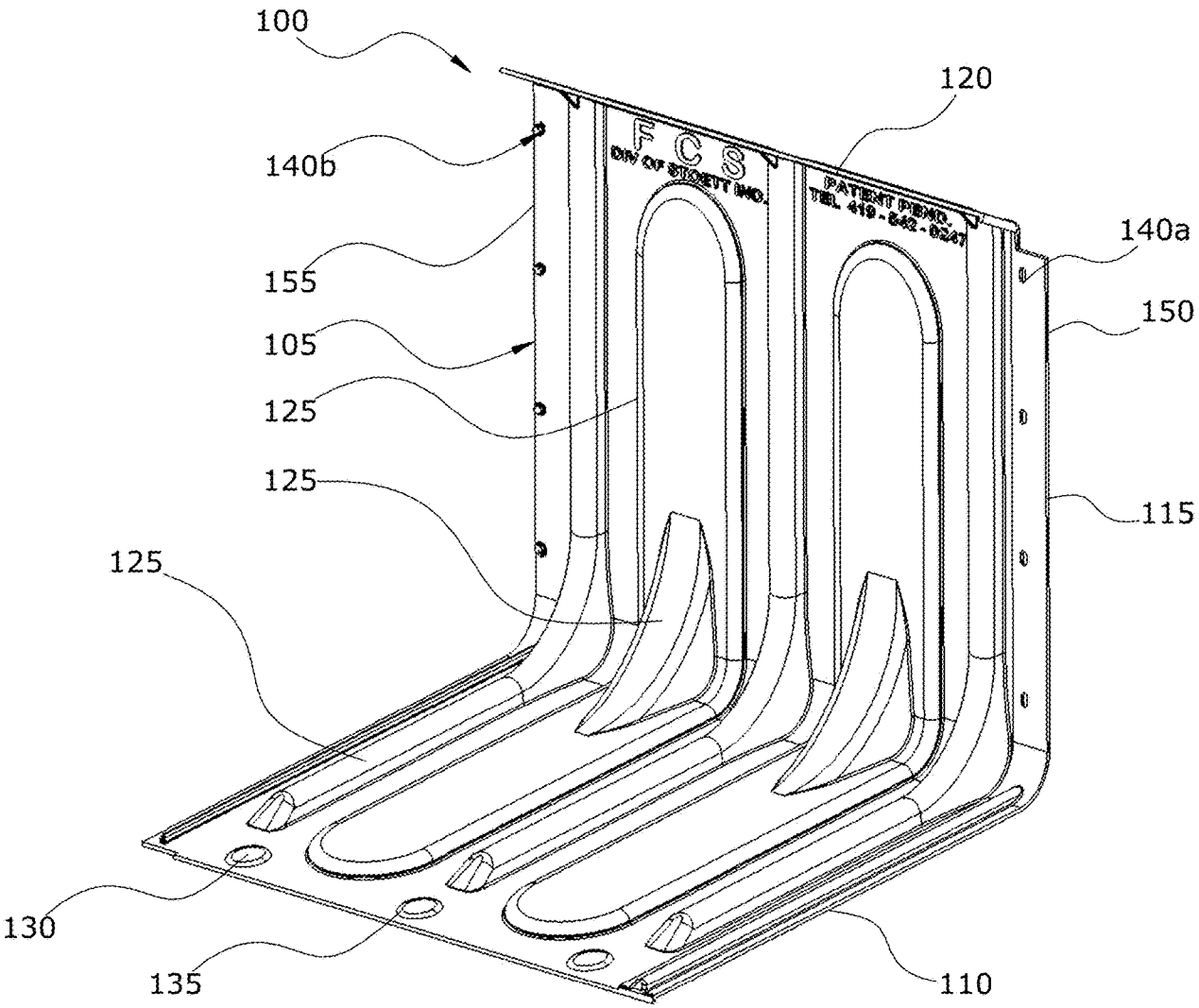
FIG. 7 shows a perspective view of a liquid containment panel.

FIG. 7 shows a liquid containment panel 100 including a body 105 having a substantially horizontal portion 110 and a substantially vertical portion 115. The body 105 is configured to be freestanding with the substantially vertical portion 115 in an upright position. The composition of the body 105 includes a thermoplastic olefin. The body 105 of the liquid containment panel 100 is flexible, has an average thickness between about 0.125 inches to about 0.375 inches, and is formed by injection molding. The substantially vertical portion 115 includes a projection 120 along a top edge thereof, where the projection 120 extends over the substantially horizontal portion 110. A plurality of different corrugations 125 are formed in the body 105. As can be seen, the various corrugations 125 can run between the substantially horizontal portion 110 and the substantially vertical portion 115. The substantially horizontal portion 110 includes one or more apertures 130 and mounting points 135 for coupling the liquid containment panel 100 to a surface such as the ground using one of a spike and an earth screw.

Figures 8A, 8B:
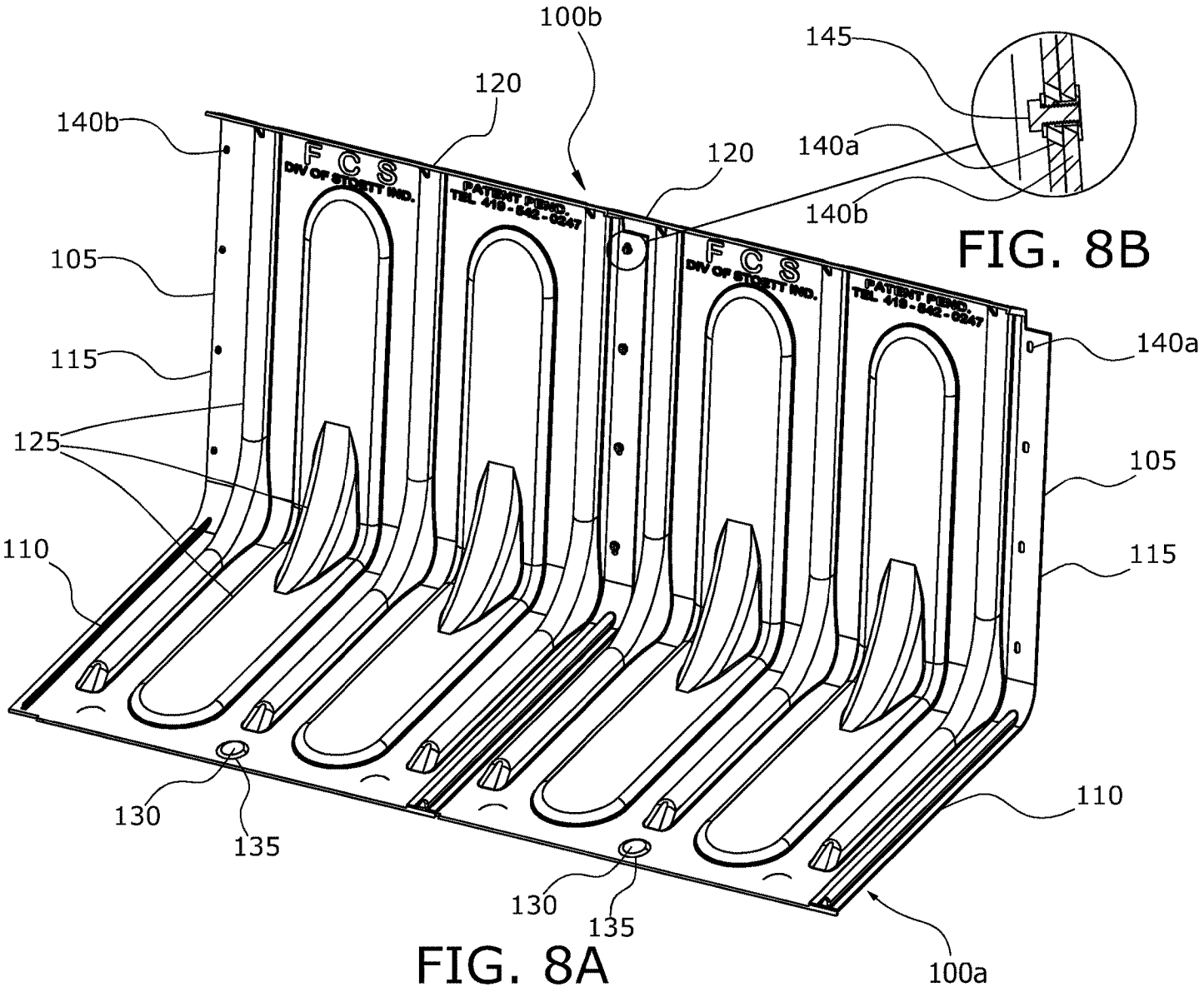
FIG. 8A shows a perspective view of a first liquid containment panel coupled to a second liquid containment panel, where
FIG. 8B is a detailed view of a coupling feature used to join the first liquid containment panel and the second liquid containment panel.

FIG. 8A shows a first liquid containment panel 100*a* coupled to a second liquid containment panel 100*b*, where FIG. 8B is a detailed view of coupling features 140*a*, 140*b* used to join the first liquid containment panel 100*a* and the second liquid containment panel 100*b*. A first coupling feature 140*a* is located along a first side edge 150 of the body 105, where the first coupling feature 140*a* is configured to couple the liquid containment panel 100*a*, 100*b* to another liquid containment panel along the first side edge 150. A second coupling feature 140*b* is located along a second side edge 155 of the body 105, where the second coupling feature 140*b* is configured to couple the liquid containment panel 100*a*, 100*b* to another liquid containment panel along the second side edge 155. As shown one of the first coupling feature 140*a* and the second coupling feature 140*b* of the liquid containment panel 100*a*, 100*b* is configured to be coupled to the other of the first coupling feature 140*a* and the second coupling feature 140*b* of another liquid containment panel using a fastener 145. The example of the fastener 145 shown in the detailed view of FIG. 8B is bolt and nut type fastener or a T-nut fastener. It should be appreciated that other types of fasteners can be used, including tool-less fasteners, wing-nuts, press-fittings, etc.

Figure 10:
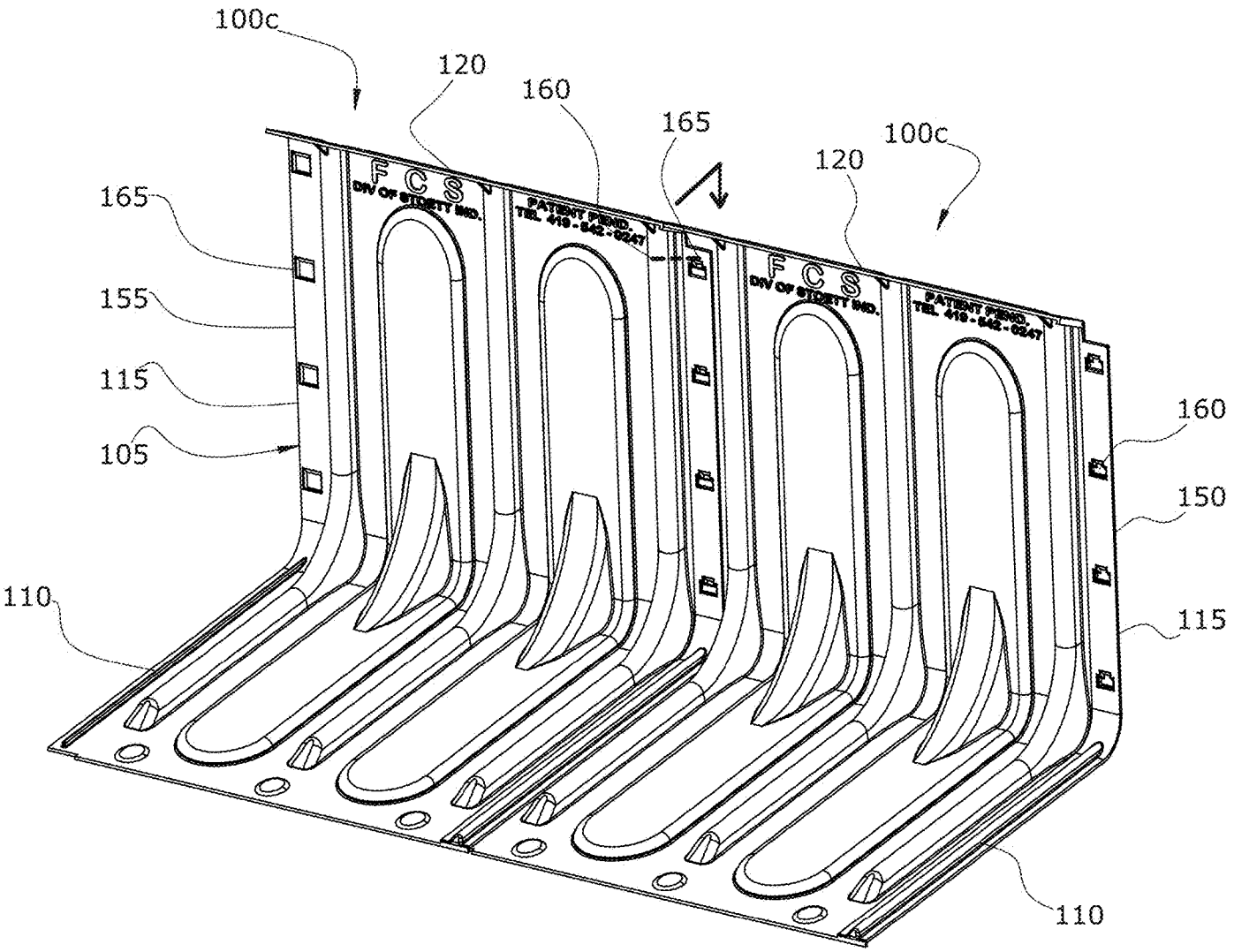
FIG. 10 shows a perspective view of two liquid containment panels according to FIG. 9 being joined by respective male and female coupling features.
Figures 11A, 11B, 11C:
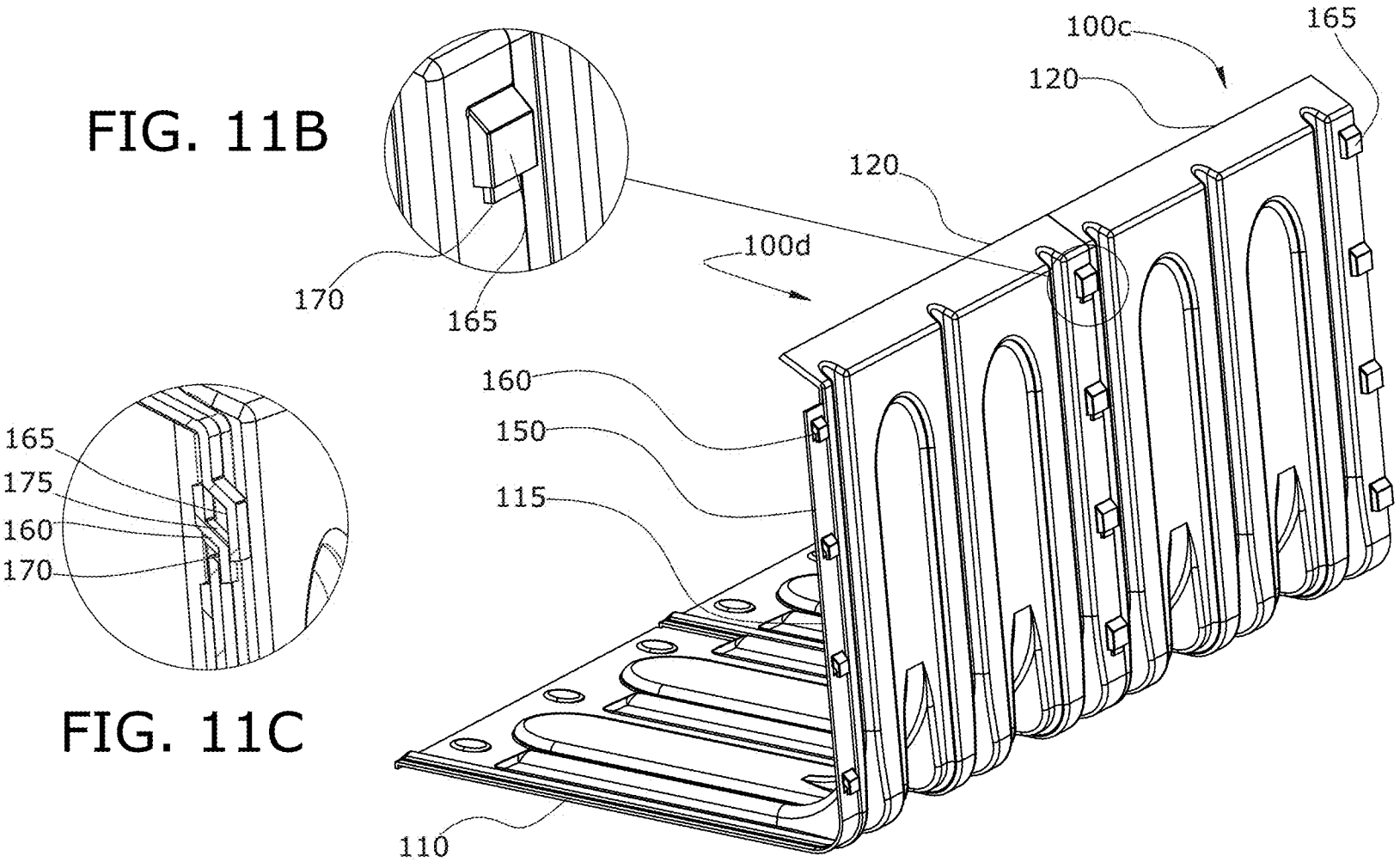
FIG. 11A shows a perspective view of the reverse side of the two liquid containment panels of FIG. 10 as joined by the respective male and female coupling features, where
FIG. 11B shows a detailed view of the male coupling feature inserted into the female coupling feature.
FIG. 11C shows a cross-section of the male-female coupling.

FIG. 9 shows another liquid containment panel 100 having male 160 and female 165 coupling features along edges 150, 155 thereof. The first coupling feature includes a male coupling element 160 and the second coupling feature includes a female coupling element 165, where the male coupling element 150 is configured to be received by the female coupling element 165, thereby allowing the first side edge 150 of the liquid containment panel to be coupled to the second side edge 155 of another liquid containment panel. FIG. 10 shows two such liquid containment panels 100*c*, 100*d* being joined by respective male 160 and female 165 coupling features. The arrow in FIG. 10 is meant to depict the travel motion for coupling the the respective male 160 and female 165 coupling features by inserting the male coupling feature 160 into the female coupling feature 165 and lowering the one liquid containment panel 100*c* relative to the other liquid containment panel 100*d* so both rest upon the ground. In doing so, a tab 170 of the male coupling feature 160 is positioned through and behind an opening 175 of the female coupling feature 165. FIG. 11A shows the reverse side of the two liquid containment panels 100*c*, 100*d* of FIG. 10, as joined by the respective male 160 and female 165 coupling features. The detailed views of FIGS. 11B and 11C show perspective and cross-sectional views of the male coupling feature 160 and tab 175 passing through the opening 175 of the female coupling feature 165. Insertion of the male coupling feature 160 into the female coupling feature 165 thereby secures the liquid containment panels 100*c*, 100*d* together.

FIG. 12 shows another liquid containment panel 100 which has loop 180 and aperture 185 coupling features along first 150 and second 155 edges thereof. FIG. 13A shows a wedge 190 that can be placed through the loop coupling feature 180 of one liquid containment panel 100*e*, where the loop coupling feature 180 is inserted through the aperture coupling feature 185 of another liquid containment panel 100*f*. As shown in the detailed view of FIG. 13B, the loop coupling feature 180 is inserted into the aperture coupling feature 185 and the wedge 190 serves to pin the liquid containment panels 100*e*, 100*f* together. FIG. 13C shows two liquid containment panels 100*e*, 100*f* joined by insertion of the respective loops 180 through the respective apertures 185 and secured using wedges 190 placed through the loops 180.

FIG. 14A shows a frame 195 and FIG. 14B shows how the frame 195 can engage a liquid containment panel 100. In the embodiment shown, the frame 195 is configured to engage both the substantially horizontal portion 110 and the substantially vertical portion 115 of the body 105 of the liquid containment panel 100. The frame 195 can be formed of a ferrous or aluminum alloy, can have one or more engagement members 200 that can be at least partially received within corrugations 125 in the body 105 of the liquid containment panel 100, and can have one or more cross members 205 connecting the engagement members 200. For example, the engagement members 200 can be press-fit or snap-fit into the corrugations 125. A cross member 205 of the frame 195 positioned relative to the substantially horizontal portion 110 of the body 105 can have one or more apertures 210 for coupling the frame 195 to the ground using one of a spike and an earth screw. These apertures 210 can coincide with and be juxtaposed with one or more apertures 130 and/or mounting points 135 formed in the body 105 of the liquid containment panel, thereby allowing a spike or earth screw to be simultaneously inserted through each. Alternatively, as shown, the apertures 210 can be offset from the apertures 130 and/or mounting points 135 formed in the body 105, where one or both of the frame 195 and the body 105 of the liquid containment panel 100 can be independently fastened to the ground.

FIG. 15 shows multiple liquid containment panels coupled together, including straight liquid containment panels 215 joined by an inside-curve liquid containment panel 220 and straight liquid containment panels 215 joined by outside-curve liquid containment panels 225. A liquid containment system 230 can be formed by certain numbers and configurations of liquid containment panels that can include various numbers of straight liquid containment panels 215, various numbers of inside-curve liquid containment panels 220, and/or various numbers of outside-curve liquid containment panels 225. As shown, the embodiment of the inside-curve liquid containment panel 220 effects about a 90 degree inside turn with a single liquid containment panel while the embodiment of the outside-curve liquid containment panel 225 effects about a 45 degree outside turn with two outside-curve liquid containment panels 225 being directly coupled together to provide about a 90 degree outside turn. It should be recognized that both inside-curve liquid containment panels 220 and outside-curve liquid containment panels 225 can provide turns of various degrees, allowing combinations thereof to be used in certain instances to provide additive turns of various degree sums where needed. For example, inside-curve liquid containment panels 220 and outside-curve liquid containment panels 225 can be configured to provide gradual turns (e.g., 5-30 degrees) to more abrupt turns (e.g., 45-90 degrees). Examples further include turns ranging from 5-90 degrees, with particular examples including 30 degrees, 45 degrees, 60 degrees, and 90 degrees.

FIG. 16A shows the inside-curve liquid containment panel 220 according to FIG. 15, where FIG. 16B shows a detailed view of a coupling features 140*a*, 140*b* (as per those shown in FIG. 7 employing fastener 145) for joining the inside-curve liquid containment panel 220 to another liquid containment panel. FIG. 16C shows a detailed view of a bracket 235 for coupling the substantially horizontal portion 110 of the body 105 of the inside-curve liquid containment panel 220 to another liquid containment panel. For example, the bracket 235 can join the second side edge 155 of the substantially horizontal portion 110 of the inside-curve liquid containment panel 220 to the first side edge 150 of a substantially horizontal portion 110 of another liquid containment panel, or vice versa. The bracket 235 can be formed of metal (e.g., ferrous or aluminum alloy) and can reinforce the coupling and sealing of the inside-curve liquid containment panel 220 to another liquid containment panel, where additional stresses or forces can be imposed by liquids contained thereby, especially in response to forcing a liquid to change direction abruptly, as can be the case for flood waters.

FIG. 17A shows the inside-curve liquid containment panel 220 according to FIGS. 15 and 16A, where a coupling feature 140*b* joins a substantially vertical portion 115 of a body 105 of the inside-curve liquid containment panel 220 to a coupling feature 140*a* of a substantially vertical portion 115 of a body 105 of a straight liquid containment panel 215 (e.g., liquid containment panel 100 as per FIG. 7) and the bracket 235 couples the substantially horizontal portion 110 of the body 105 of the inside-curve liquid containment panel 220 to the substantially horizontal portion 110 of the body 105 of the straight liquid containment panel 215 (e.g., liquid containment panel 100 as per FIG. 7). The detailed inset of FIG. 17B shows coupling feature 140*b* of the inside-curve liquid containment panel 220 joined with coupling feature 140*a* of the straight liquid containment panel 215 using fastener 145.

FIG. 18 shows the outside-curve liquid containment panel 225 according to FIG. 15, including coupling features 140*a*, 140*b* for joining the outside-curve liquid containment panel to other liquid containment panels and a bracket 235 for coupling a substantially horizontal portion 110 of the body 105 of the outside-curve liquid containment panel 225 to another liquid containment panel. FIG. 19 shows how two outside-curve liquid containment panels 225 can be coupled together to further curve a structure formed from multiple liquid containment panels; e.g., two 45 degree curved panels are additive to provide a 90 degree curve. FIG. 20 shows an underside of FIG. 19, where brackets 235 are used for coupling the substantially horizontal portions 110 of the bodies 105 of the outside-curve liquid containment panels 225 to each other and to another liquid containment panel.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A liquid containment panel comprising:

a body including a substantially horizontal portion and a substantially vertical portion, the body configured to be freestanding with the substantially vertical portion in an upright position;

wherein the body includes a thermoplastic olefin, wherein the thermoplastic olefin is characterized by a melt flow rate (g/10 min) 2.16 kg, 230° C. between about 13 and about 17 and a flex strength (MPa) 2.16 kg, 230° C. between about 18 and about 20.

2. The liquid containment panel of claim 1, wherein the thermoplastic olefin includes particles of elastomer in a matrix of thermoplastic.

3. The liquid containment panel of claim 2, wherein:

the elastomer particles include a member selected from a group consisting of polyisoprene, polybutadiene, ethylene propylene rubber, ethylene propylene diene monomer rubber, ethylene-octene, ethylbenzene, styrene ethylene butadiene styrene, and combinations thereof; and the matrix of thermoplastic includes a member selected from a group consisting of polyethylene, polypropylene, block copolymer polypropylene, and combinations thereof.

4. The liquid containment panel of claim 1, wherein the thermoplastic olefin includes a filler selected from a group consisting of talc, fiberglass, carbon black, carbon fiber, wollastonite, and combinations thereof.

5. The liquid containment panel of claim 1, wherein the thermoplastic olefin is further characterized by:

a yield strain (%) between about 6 and about 10;

a yield strength (MPa) between about 11 and about 16;

a break (elongation %) between about 10 and about 14; and a Shore A hardness of at least about 93.

6. The liquid containment panel of claim 1, wherein the body is flexible.

7. The liquid containment panel of claim 1, wherein the body has a thickness between about 0.125 inches to about 0.375 inches.

8. The liquid containment panel of claim 1, wherein the body is formed by injection molding.

9. The liquid containment panel of claim 1, wherein the body including the substantially horizontal portion and the substantially vertical portion has a substantially L-shaped cross-section.

10. The liquid containment panel of claim 1, wherein the thermoplastic olefin has a Poisson's ratio of between about 0.40 and about 0.52.

11. A liquid containment panel comprising:

a body including a substantially horizontal portion and a substantially vertical portion, the body configured to be freestanding with the substantially vertical portion in an upright position, wherein a lip is formed along a top edge of the substantially vertical portion, wherein the lip extends away from the top edge of the substantially vertical portion to extend over the substantially horizontal portion, wherein the lip extends away from the top edge at an acute angle relative to the horizontal direction, wherein the lip is configured to cause water encountering an upper surface of the lip to flow along the upper surface of the lip and to fall to a side of the substantially vertical portion facing away from the substantially horizontal portion;

wherein the body includes a thermoplastic olefin.

12. The liquid containment panel of claim 11, wherein the body further comprises a plurality of corrugations.

13. The liquid containment panel of claim 12, wherein at least a portion of the plurality of corrugations run between the substantially horizontal portion and the substantially vertical portion.

14. The liquid containment panel of claim 11, wherein a corrugation is formed in each of the lip and the substantially vertical portion, wherein the corrugation extends through the top edge of the substantially vertical portion.

15. The liquid containment panel of claim 14, wherein the corrugation terminates at the upper surface of the lip.

16. A liquid containment panel comprising:

a body including a substantially horizontal portion and a substantially vertical portion, the body configured to be freestanding with the substantially vertical portion in an upright position, wherein the body includes a plurality of corrugations formed therein, wherein the plurality of corrugations includes a plurality of indentations formed in the body, wherein the body includes a thermoplastic olefin; and a frame configured to engage at least one of the substantially horizontal portion and the substantially vertical portion of the body, wherein at least one of the indentations formed in the body is configured to receive a portion of the frame therein when the frame engages the at least one of the substantially horizontal portion and the substantially vertical portion of the body.

17. The liquid containment panel of claim 16, wherein the frame includes a ferrous or aluminum alloy.

18. The liquid containment panel of claim 16, wherein the frame includes one of an aperture or a mounting point for coupling the frame to the ground using one of a spike or an earth screw.

19. The liquid containment panel of claim 16, wherein the portion of the frame is configured to be press-fit or snap fit into the at least one of the indentations formed in the body.

20. The liquid containment panel of claim 16, wherein a first one of the plurality of the corrugations is formed at least partially in each of the substantially horizontal portion and the substantially vertical portion, wherein the frame includes a first engagement member coupled to a second engagement member, wherein the first engagement member is configured to be received within a first indentation formed by the first one of the plurality of the corrugations along the substantially horizontal portion and the second engagement member is configured to be received within a second indentation formed by the first one of the plurality of the corrugations along the substantially vertical portion.

* * * * *